US006754139B2

(12) United States Patent
Herbstman et al.

(10) Patent No.: US 6,754,139 B2
(45) Date of Patent: Jun. 22, 2004

(54) ANIMATED TIMEPIECE

(75) Inventors: David F. Herbstman, Seattle, WA (US); Marco Prieschl, Brooklyn, NY (US)

(73) Assignee: Timefoundry, LLC, New York, NY (US)

( * ) Notice: Subject to any disclaimer, the term of this patent is extended or adjusted under 35 U.S.C. 154(b) by 362 days.

(21) Appl. No.: 09/997,827

(22) Filed: Nov. 29, 2001

(65) Prior Publication Data

US 2003/0099159 A1 May 29, 2003

(51) Int. Cl.[7] ..... G04B 19/06; G04C 19/00

(52) U.S. Cl. ..... 368/77; 368/79; 368/232; 368/233

(58) Field of Search ..... 368/223, 228, 368/231, 232, 233, 234, 239–242, 77–82

(56) References Cited

U.S. PATENT DOCUMENTS

| | | | | | |
|---|---|---|---|---|---|
| 3,439,492 | A | | 4/1969 | Gravenson | 368/68 |
| 3,525,209 | A | | 8/1970 | Ladas | 368/77 |
| 3,665,702 | A | | 5/1972 | Calame | 368/233 |
| 3,803,831 | A | | 4/1974 | Horzick | 368/233 |
| 4,034,555 | A | * | 7/1977 | Rosenthal | 368/232 |
| 4,759,002 | A | * | 7/1988 | Cash | 368/15 |
| 5,586,089 | A | * | 12/1996 | McGarvey | 368/223 |
| 5,751,663 | A | * | 5/1998 | Johnson | 368/77 |
| 5,943,300 | A | | 8/1999 | Johnson | 368/77 |
| 6,463,012 | B1 | * | 10/2002 | Bar-Yona | 368/80 |
| 6,507,536 | B1 | * | 1/2003 | Keatch | 368/16 |

FOREIGN PATENT DOCUMENTS

| | | | | |
|---|---|---|---|---|
| CH | 296061 | * | 4/1954 | 368/223 |
| CH | 329959 | * | 6/1958 | 368/223 |
| CH | 332202 | * | 10/1958 | 368/223 |
| CH | 349215 | * | 11/1960 | 368/223 |
| CH | 351543 | * | 2/1961 | 368/223 |
| FR | 1076518 | * | 10/1954 | 368/223 |
| GB | 772228 | * | 4/1957 | 368/223 |

OTHER PUBLICATIONS

"Exraction Clock", sixties stuff web page, no date.
Boreal watch photos, no date.

* cited by examiner

*Primary Examiner*—David Martin
*Assistant Examiner*—Jeanne-Marguerite Goodwin
(74) *Attorney, Agent, or Firm*—Cohen, Pontani, Lieberman & Pavane

(57) ABSTRACT

A timepiece includes a plurality of coaxially mounted disks which are driven with different periods, at least some of the disks having a time indicator area which is visible through one or more transmissive areas on one or more disks which lie over it. In a preferred embodiment, one of the disks is provided with three concentric annular zones and is driven with a period of sixty seconds. The outermost zone has discrete reflective areas which are visible through discrete transmissive areas in an overlying annular zone. The inner zones have discrete transmissive areas through which discrete reflective areas in two concentric annular zones on two respective lower disks are visible. The lowermost disk is driven with a period of twelve hours and is visible through a central transparent area of an intermediate disk which is driven with a period of sixty minutes. The appearance of the reflective areas through the transmissive areas gives an impression of a flowing change in patterns around each of the zones, while indicator areas visible through the transmissive areas give an indication of seconds, minutes, and hours. Other embodiments utilize zones having transmissive areas of varying radial width and/or transmissivity to achieve a unique visual effect. A simple embodiment has reflective areas on a stationary face and a single rotating disk thereover, with indicator areas having the form of conventional watch hands therebetween. The desired visual effect may be chosen by computer simulation of the transmissive and reflective areas. Likewise the timepiece may implement as a digital display.

67 Claims, 23 Drawing Sheets

ANIMATED TIMEPIECE

BACKGROUND OF THE INVENTION

1. Field of the Invention

The present invention relates to timepieces, and in particular to timepieces wherein a conventional clock mechanism is used to rotate ring-like zones with indicator areas for the seconds, minutes and hours. The invention further relates to a digitally generated display which visually simulates such timepieces.

2. Description of the Related Art

U.S. Pat. No. 3,525,209 entitled "Orbital Clock" discloses a clock wherein a conventional clock drive mechanism having an hour shaft, a minute shaft, and a second shaft is used to drive respective disks of different diameters having thereon time indicator areas in the form of translucent holes having different colors representing the hour, minute, and second. The disks are designed with light transmissive annular areas and arranged with a light source behind them in order to give the impression of three concentrically orbiting planets of different size and color. While the clock is designed to give the impression of planets which are optically floating in a dark cube, the only observable motion is the same as the hands of a clock wherein the planets represent respective second, minute, and hour hands. It is the object of the "Orbital Clock" to provide a timepiece which is minimalist art, providing a reduction in apparent detail by obscuring mechanical, structural, and electronic elements.

U.S. Pat. No. 3,803,831 entitled "Visual Indication Apparatus with Rotatable Transparent Discs" discloses the use of a conventional clock drive mechanism to drive translucent disks of different diameters having thereon angularly graduated color intensities which form time indicator areas at the boundary between the lightest and darkest areas. These disks pass over a stationary face having a color intensity which is angularly graduated in the opposite direction. While intended to create a unique visual effect, the effect is still conventional insofar as the time indicator areas are viewed directly without any intervening features to animate them.

SUMMARY OF THE INVENTION

It is an object of the invention to provide a timepiece which displays the time in an interesting manner by animating the time indicator areas to create a continuous or stepwise change in their appearance.

According to the invention, this object is achieved through the use of pairs of overlapping annular zones, wherein the zones in each pair exhibit relative rotation, one of the zones in each pair constituting a matte, the other constituting a fill. As used herein, these terms are defined as follows.

Matte: A stencil or filter that allows varying amounts light to be transmitted in certain areas. The variation can range from complete transparency to complete opacity. A matte can be created by printing or painting a transparent medium such as glass or plastic, or by cutting apertures in an opaque material, which can be any color.

Fill: A material placed behind the matte which is visible through the transparent or semi-transparent areas of the matte.

According to an embodiment having six annular zones on six respective laminas, the second, minute, and hour mattes are concentrically arranged so that each is visible. The second, minute, and hour fills are arranged behind the respective mattes, and driven by the second, minute, and hour outputs of a conventional clock mechanism. Each fill preferably has an array of patterns including a time indicator area which is optically distinguishable from the rest of the fill, whereby the portion of the patterns visible through the transmissive areas is constantly changing while the indicator areas are always (or at least intermittently) visible through the transmissive areas to give an indication of time.

According to an embodiment having six annular zones on four laminas, the second matte is arranged on the first lamina, while the second fill, minute matte, and hour matte are concentrically arranged on a second lamina, which is driven by the second output of the clock mechanism. The minute fill and hour fill are arranged on respective further laminas so that the patterns and indicator areas thereon are visible through the transmissive areas of the respective mattes thereabove, these laminas being driven by the minute and hour outputs of the clock mechanism. This embodiment not only offers the advantage of simple construction, but since the second lamina is rotating at the speed of a second hand, i.e. with a period of one minute, the portions of the patterns of all the fills which are visible through the respective transmissive areas of the mattes change continuously and with sufficient speed to create the impression of flow through a continuous series of patterns.

According to another embodiment, the zones of the mattes and fills may be provided on cylindrical surfaces which are rotated relative to each other, the ring-like zones on the fills being partially visible through the transmissive areas in the ring-like zones of the mattes. In this regard, the term "ring-like" will be understood to mean zones which are either annular, or in the form of cylindrical strips.

The visual effects which may be achieved by rotating mattes relative to fills are not limited to the appearance of discrete reflective or transmissive areas of the fills through discrete transmissive areas of the mattes. According to another embodiment, the mattes and fills may have continuous transmissive areas which increase in width in an angular direction about an axis of rotation. At least one of the mattes and fills may also vary in transmissivity in an angular direction about the axis. According to a preferred embodiment having three disks, a first disk has a first transparent zone which serves as a second fill, the first zone having a radial outer part and a radial inner part which serve as minute and hour mattes for second and third zones (minute and hour fills) on respective second and third disks underneath the first disk. The inner part and the outer part of the first zone, as well as the second and third zones, have an increase in radial width which ends at an indicator area.

It is also possible to have a three disk arrangement wherein the first disk or second fill has a first zone which does not vary in radial width, but does vary in transmissivity in an angular direction about its axis. This is preferably a continuous shading from light to dark, culminating at an indicator area. The first zone has an outer part and an inner part which serve as minute and hour mattes for second and third zones (minute and hour fills) on respective second and third disks underneath the first disk. These disks have respective zones which needn't have any angular variation in transmissivity, but must have indicator areas. The first indicator area is preferably in the form of a radially extending slice which is optically distinguishable from the rest of the first zone, so that passing over the second and third indicator areas gives the impression of "blips" on a radar screen.

In another three disk embodiment, the first disk has a radially outer part and a radially inner part which each have discrete transmissive areas at regular angular intervals about the parts. The second and third disks thereunder have discrete reflective areas at regular angular intervals which are preferably at a slightly different spacing than the transmissive areas in the first disk. The appearance of a complete reflective area through an overlying transmissive area rolls around the first disk with a period determined by the angular intervals. A similar effect may be achieved by having only a single disk or second fill overlying a stationary face having first and second zones on which the reflective areas are provided at regular angular intervals. Here the second and third indicator areas may be implemented as conventional watch hands disposed between the first disk and the face, and designed to be visible through the transmissive areas, which are preferably apertures.

In a variation of the three disk embodiment having transmissive areas at regular angular intervals around the zones, the transmissive areas change transmissivity gradually from one area to the next, preferably by changing colors. The outer and inner areas of the first zone may be provided with colors which alternate at the same angular intervals as the colors on the second and third disks therebelow, thereby giving the impression of a constant change of colors of the first disk as it rotates. Here too a similar effect may be achieved by having only a single disk or second fill overlying a stationary face having first and second zones on which the reflective areas are provided at regular angular intervals, the second and third indicator areas being implemented as conventional watch hands between the rotating disk and the face.

The shapes of the transmissive areas in the mattes and the patterns in or on the fills are chosen to give a pleasing visual effect, and may be determined empirically by using computer software to generate images showing how the clock face will appear in operation. The colors may likewise be adjusted using software until an effect pleasing to the eye is found. Likewise, the timepiece itself may be implemented as a digital display which gives the same visual impression a timepiece realized with rotating laminas or disks. The invention as claimed should thereby be understood to include any digital or electronic implementation which gives the same visual impression as the mechanical embodiments described herein.

The timepiece may be designed with fills which are wholly reflective, so that ambient or directed light from outside the clock is sufficient to tell the time. However the fills may also be designed so that the patterns are translucent or transparent, the indicator area being of a different color or otherwise optically distinguishable from the rest of the fill, the laminas being backlit so that the face is visible for telling time in a dark room. The choice of shapes and colors in this case could be used for a highly decorative outdoor clock in a commercial area, or a clock in an area with limited lighting such as a bar, discotheque, or theater.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
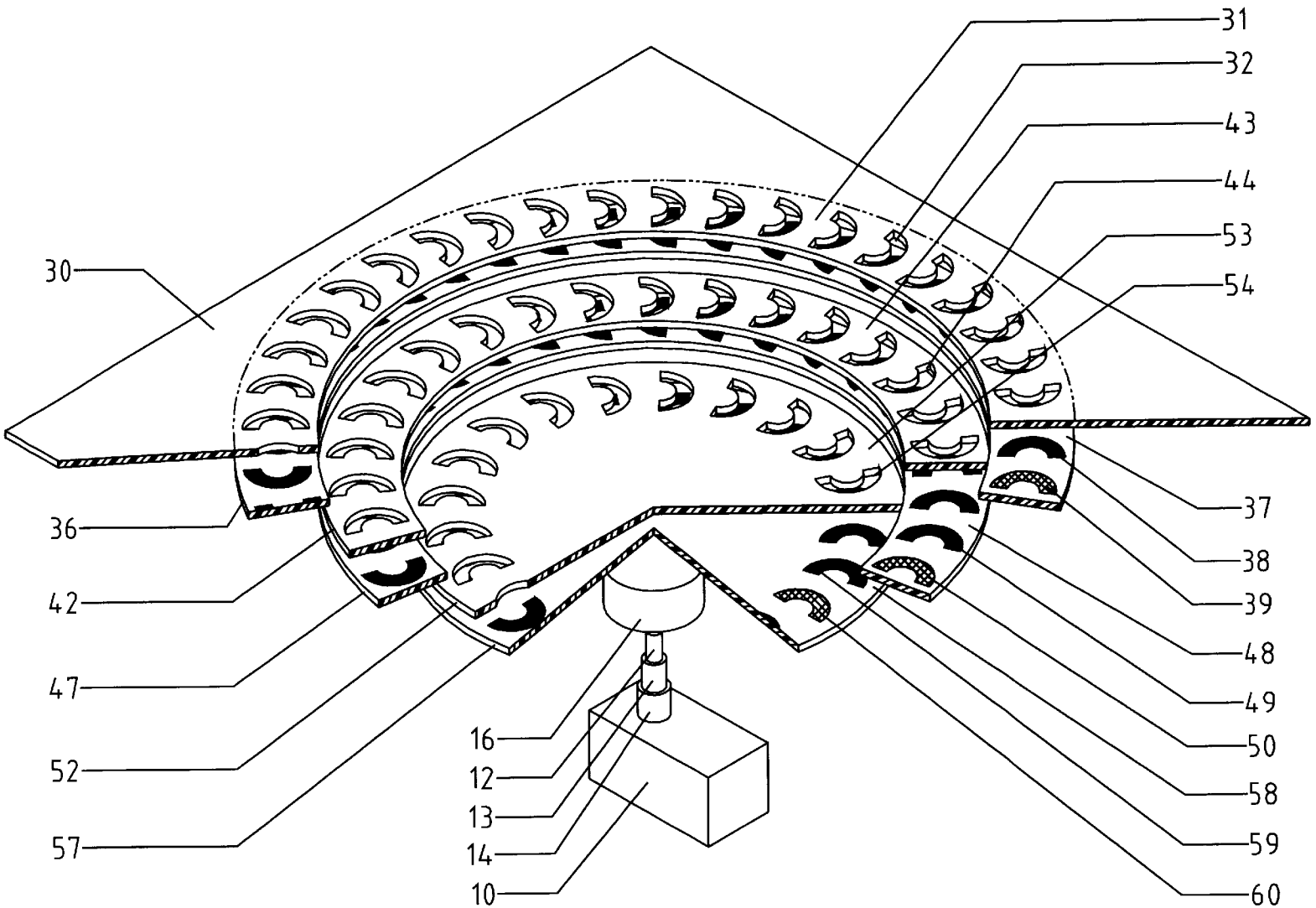
FIG. 1 is an exploded cutaway perspective of a six layer clock according to the invention.

Referring to FIG. 1, a first embodiment of clock according to the invention includes first through sixth laminas 30, 36, 42, 47, 52, and 57; a conventional clock drive mechanism 10 having a second output 12, a minute output 13, and an hour output 14; and a coupling device 16. The first, third, and fifth lamina 30, 42, 52 have respective first, third, and fifth annular zones 31, 43, 53 with respective first, second, and third discrete transmissive areas 32, 44, and 54 regularly spaced about the respective zones. The first, third, and fifth annular zones thus appear as stencils which serve, respectively, as a second matte, a minute matte, and an hour matte.

The second, fourth, and sixth laminas 36, 47, and 57 have respective second, fourth, and sixth annular zones 37, 48, 58 with respective first, second, and third arrays of patterns 38, 49, 59 regularly spaced about the respective zones. Among each of the arrays is a respective first, second, and third indicator area 39, 50, 60 which occupies a limited angular area and is optically distinguishable from the rest of the respective annular zone. The second, fourth, and sixth annular zones 37, 48, 58 are coaxial with and overlapped by respective first, third, and fifth annular zones 31, 43, 53, whereby the first, second, and third pattern arrays 38, 49, 59, including the respective indicator areas 39, 50, 60, are visible through respective first, second, and third discrete transmissive areas 32, 44, 54. The second, fourth, and sixth annular zones 37, 48, 58 serve, respectively, as a second fill, a minute fill, and an hour fill which are rotated with respective periods of one minute, one hour, and twelve hours. The appearance of the first, second, and third indicator areas 39, 50, 60 through the respective transmissive areas 32, 44, 54 thereabove thus gives a visual impression of time in the same fashion as a conventional analog clock, the indicator areas occupying the positions of the second, minute, and hour hands.

Figure 2:
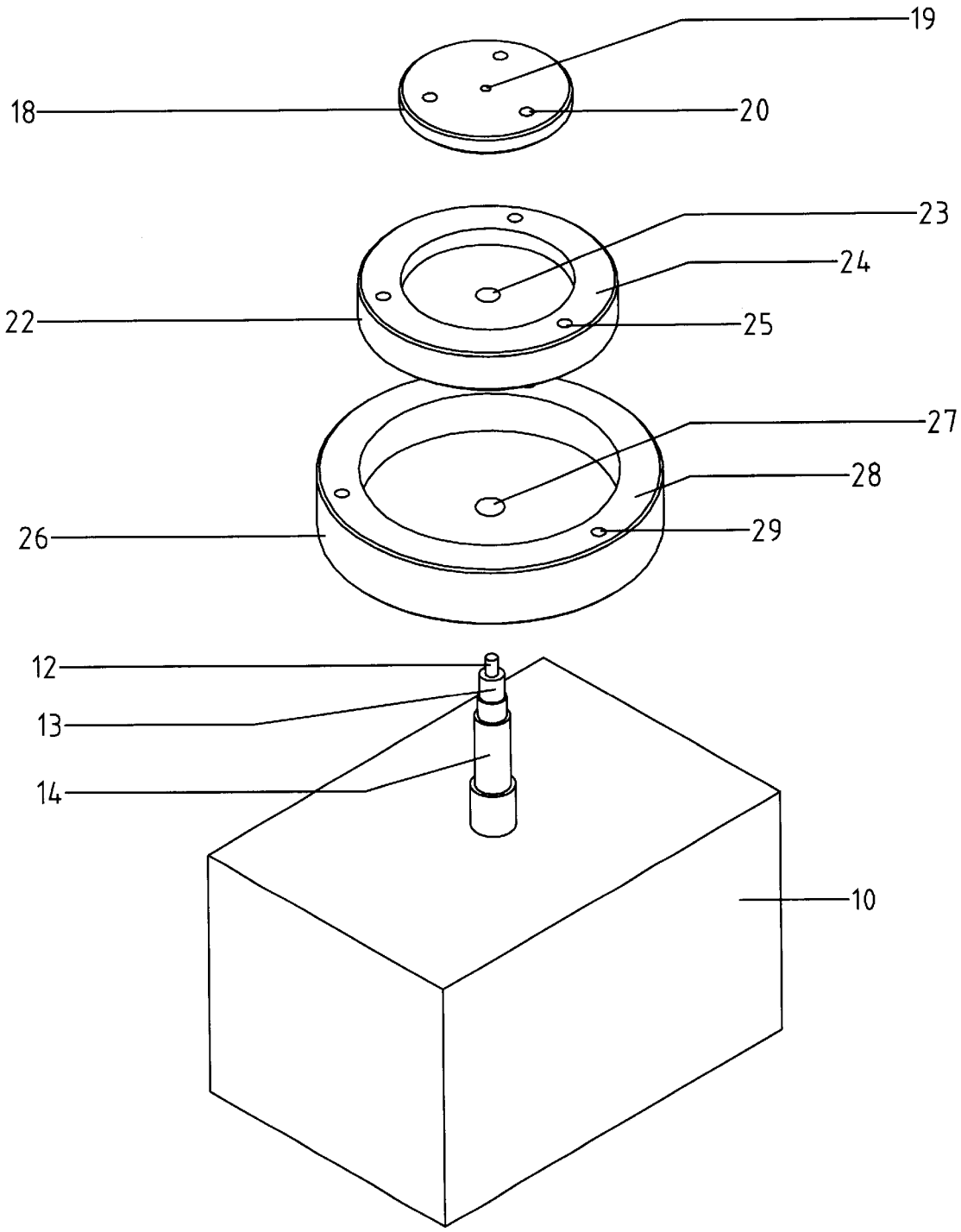
FIG. 2 is an exploded perspective of a clock mechanism and coupling device.

FIG. 2 shows an example of a coupling device 16 exploded vertically to show the constituent second, minute, and hour drive disks 18, 22, 26. The second disk 18 has a central bore 19 which is sized for a press fit on the second output 12, and mounting holes 20. The minute disk 22 has a central bore 23 which is sized for a press fit on the minute output 13, and an annular flange 24 with mounting holes 25. The hour disk 26 has a central bore 27 sized for a press fit on the hour output 14, and an annular flange 28 with mounting holes 29.

Figure 3:
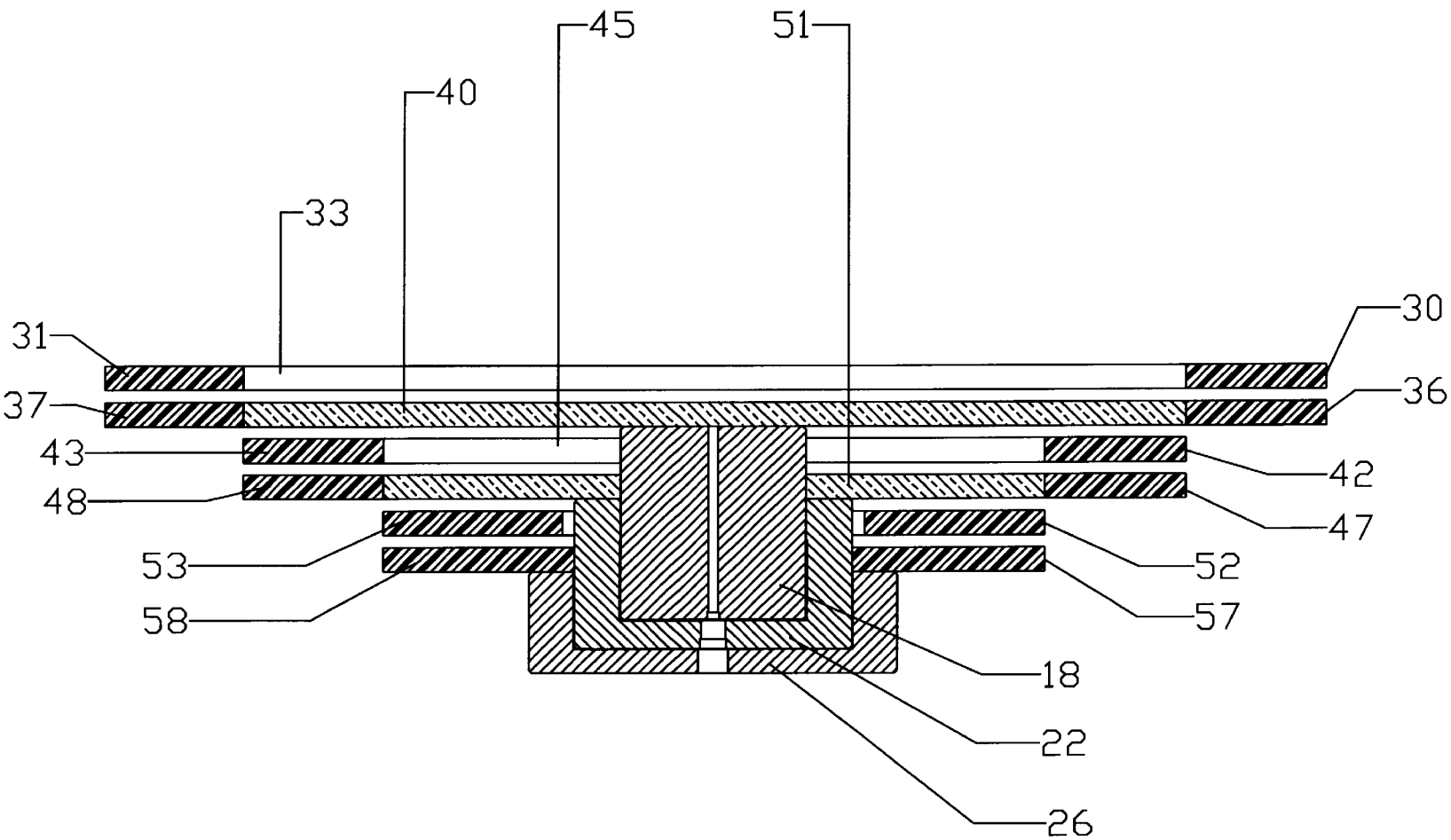
FIG. 3 is a cross-section of a six layer clock assembled to the coupling device.

Referring to FIG. 3, the three drive disks 18, 22, 26 are profiled to be nested together to form a stepped top surface for fixing to respective second, fourth, and sixth laminas 36, 47, and 57, which are preferably formed as disks. Fixing may be accomplished by screws received in the mounting holes 20, 25, 29 (FIG. 2), or by adhesive and aligning pins received in the mounting holes (corresponding holes are provided in the laminas). The first, third, and fifth laminas 30, 42, 52 are preferably fixed in a frame (not shown) and may have circular or rectangular outlines. The first lamina 30 includes a transparent area 33, in this case an aperture, surrounded by the first annular zone or second matte 31. The second lamina 36 has a transparent area 40, in this case a transparent material, surrounded by the second annular zone or second fill 37, which is overlapped by the second matte 31. The transparent material 40 is fixed to the second disk 18, and provides visibility of the annular zones therebelow.

The third lamina 42 has a transparent area 45, in this case an aperture, surrounded by the third annular zone or minute matte 43, which is visible through the transparent material 40. The fourth lamina 47 has a transparent area 51, in this case a transparent material, which is surrounded by the fourth annular zone or minute fill 48, which is overlapped by the minute matte 43. The transparent material 51 is fixed to the annular flange 24 (FIG. 2) of the minute drive disk 22, and provides visibility of the annular zones therebelow.

The fifth lamina 52 has a central aperture, which accommodates the coupling device, surrounded by the fifth annular zone 53 or hour matte, which is visible through the transparent areas above. The sixth lamina 57 likewise has a central aperture which accommodates the coupling device, and carries the sixth annular zone or hour fill 58 which is overlapped by the hour matte 53. The sixth lamina is fixed to the annular flange 28 of the hour drive disk 26.

The laminas may be formed from sheets of transparent plastic wherein all but the transmissive and transparent areas are painted or otherwise rendered opaque. However the transmissive areas in the first, third, and fifth laminas are preferably apertures, which may be cut by laser, in order to permit a sharp image of the patterns including the time indicator areas therebelow. The patterns on the second, fourth, and sixth lamina, including the indicator areas, may be reflective, so that ambient light is sufficient for a visual impression of time. However the patterns and/or the indicator areas may also be formed as transparent areas, translucent areas, or apertures, which if backlit by a light provided inside the clock will provide an image of time without any ambient or exterior light. For example, the second fill may have a translucent blue pattern with a yellow indicator area, so that a flow of blue interrupted by a spot of yellow is visible through the apertures of the second matte.

The embodiment described above is illustrative of the principle of the invention, however, since the minute matte and the hour matte are stationary, and the minute and hour fills move quite slowly, there is no impression of flow in the minute and hour annular zones. In this respect it is much like a conventional analog clock or wristwatch; at a glance, only the second hand appears to be moving. However the invention does not require that the mattes be stationary; it only requires that the indicator areas of the fills rotate with fixed time periods which will give an indication of the time.

Figure 4:
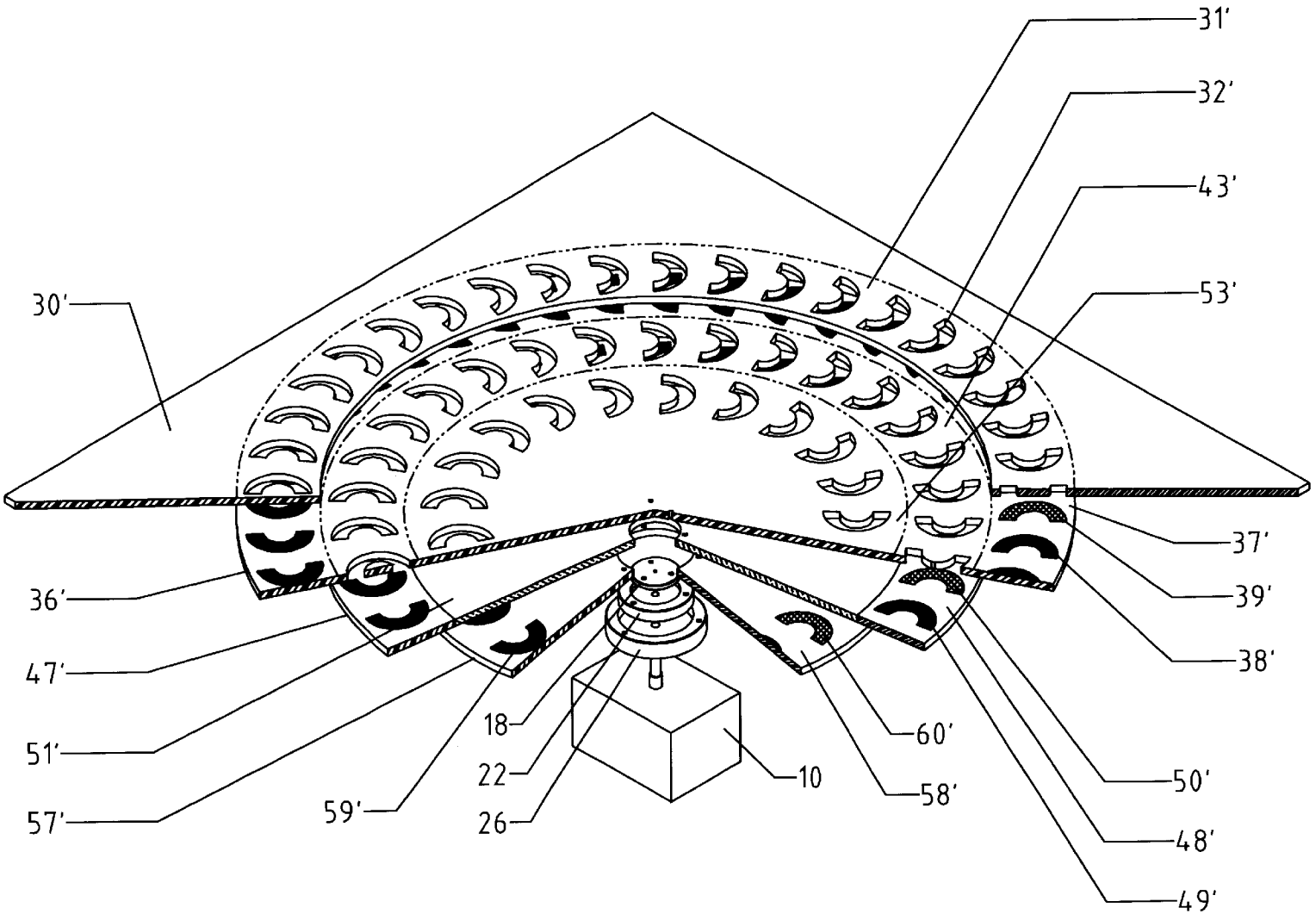
FIG. 4 is an exploded perspective of a four layer clock.
Figure 5:
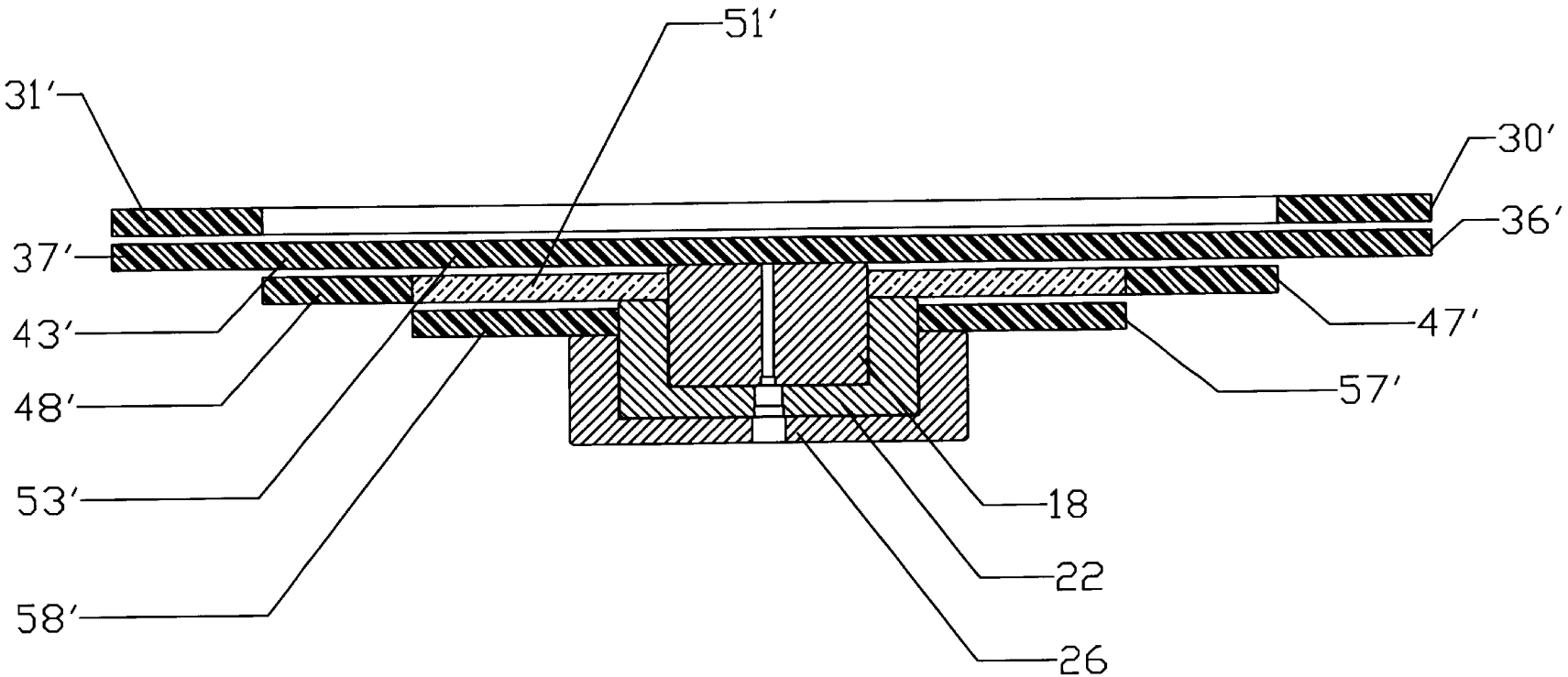
FIG. 5 is a cross-section of a four layer clock assembled to the coupling device.

Referring to FIGS. 4 and 5, a second embodiment of clock according to the invention includes a first lamina 30', a second lamina 36', a further lamina 47', a still further lamina 57', a conventional clock mechanism 10, and coupling disks 18, 22, 26. The first lamina 30' includes a first annular zone or second matte 31' having a plurality of discrete first transmissive areas regularly spaced about the zone, and a central transparent area which may be an aperture. The second lamina 36' includes a second annular zone or second fill 37' having a first array of patterns 38' and a first indicator area 39' which is overlapped by the second matte 31' The second lamina 36' is fixed to the second disk 18 (FIG. 2) as in the first embodiment, and thus rotates at one revolution per minute. However the second lamina 36' also carries the third annular zone or minute matte 43', as well as the fifth annular zone or hour matte 53'. These zones 43', 53' therefore also rotate at one revolution per minute, i.e. the same frequency as the second hand of a conventional clock.

The further lamina 47' carries the fourth annular zone or minute fill 48' having a second array of patterns 49' and an indicator area 50' which is overlapped by the minute matte 43' on the second lamina 36'. The lamina 47' also includes a transparent material 51' surrounded by the annular zone 48', the transparent material 51' being fixed to the annular flange 24 of the minute disk 22 (FIG. 2).

The still further lamina 57' carries the sixth annular zone or hour fill 58' having a third array of patterns 59' and an indicator area 60' which is overlapped by the hour matte 53' on the second lamina 36', with the transparent material 51' therebetween. The lamina 57' is fixed to the annular flange 28 of the hour disk 26 (FIG. 2).

Figure 6:
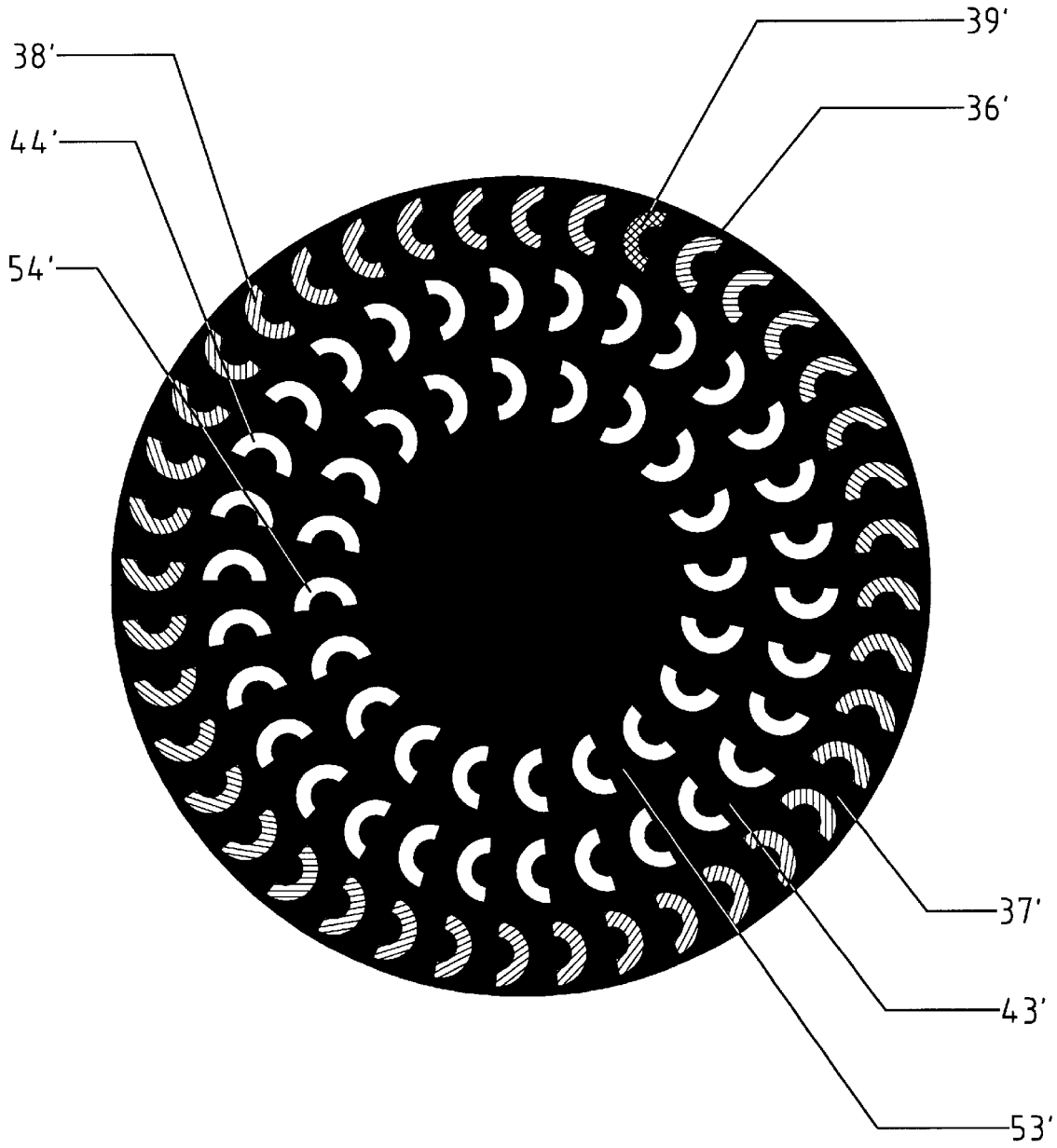
FIG. 6 is a plan view of a possible second layer for the clock of FIGS. 4 and 5.

The embodiment of FIGS. 4 and 5 offers several advantages. Obviously, since it utilizes only four laminas, it is simpler to manufacture. However the most remarkable advantage lies in providing the transmissive areas of the minute matte 43' and the hour matte 53' on the same disk as the second fill 37', i.e. the second lamina 36', thus animating the minutes and the hours. An example of this disk 36' shown in FIG. 6. Since this disk is driven with the same frequency as the second hand of a clock, it provides a visual impression of movement for the seconds, minutes, and hours. That is, the patterns 38' including the first indicator area 39' of the second fill 37' can be seen moving through the transmissive areas 32' of the second matte 31'. Meanwhile the minute matte 43' and the hour matte 53' move over the respective minute fill 48' and hour fill 58'. While the indicator areas for the minute and hour are relatively stationary, i.e. their movement is not apparent to the eye, the movement of the transmissive matte areas 44', 54' over the fill patterns 49', 59' creates an impression of fluid movement. The transmissive areas of the minute and hour mattes are preferably laser cut apertures, and the reflective patterns of the second fill may also be formed by laser cut apertures with a backing sheet provided for reflectivity. The indicator area 39' is provided with a different color backing than the backing visible through the other apertures of the pattern.

Figure 7:
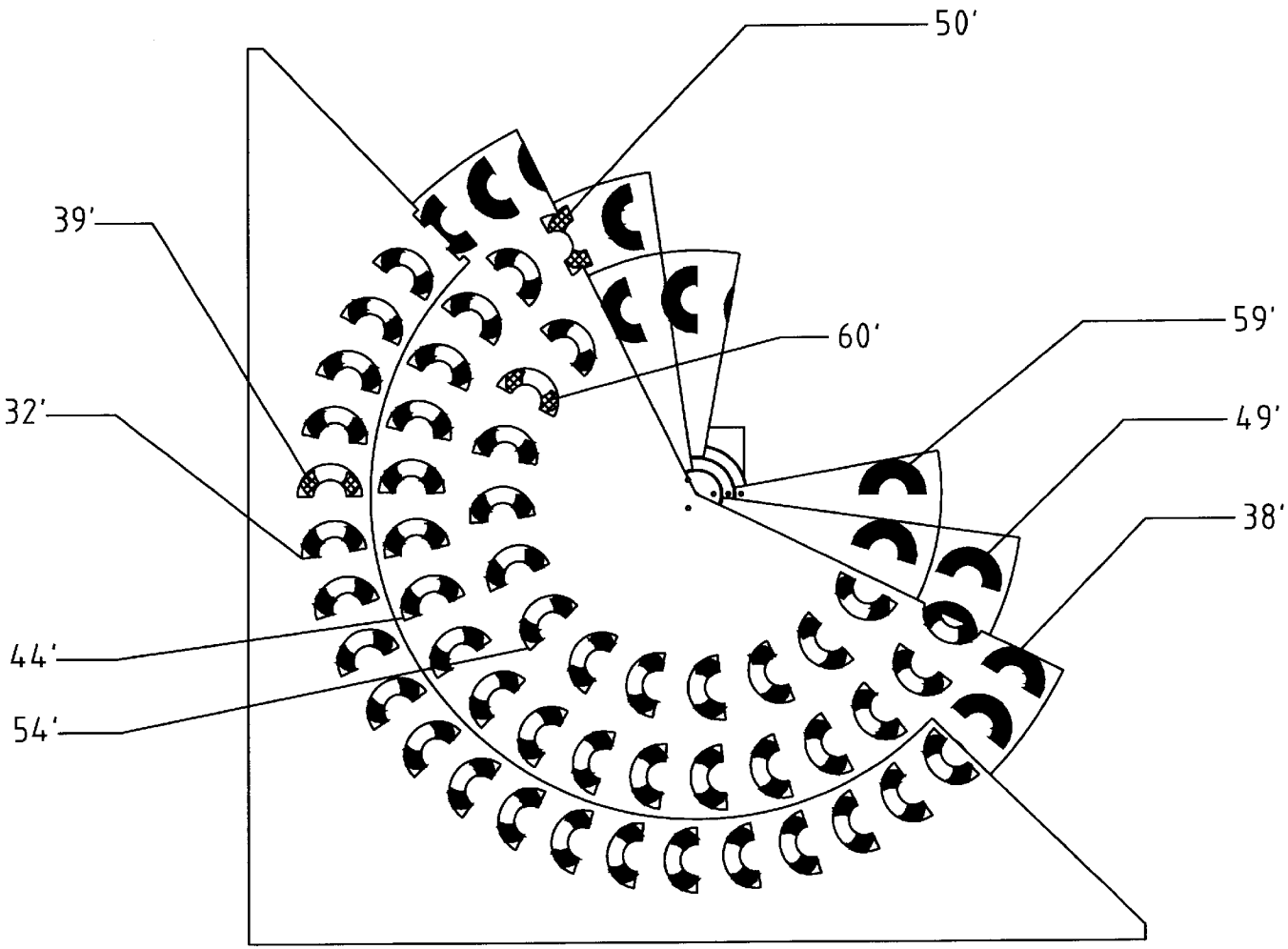
FIG. 7 is a cutaway plan view of a clock face according to FIGS. 4 and 5.
Figure 9A:
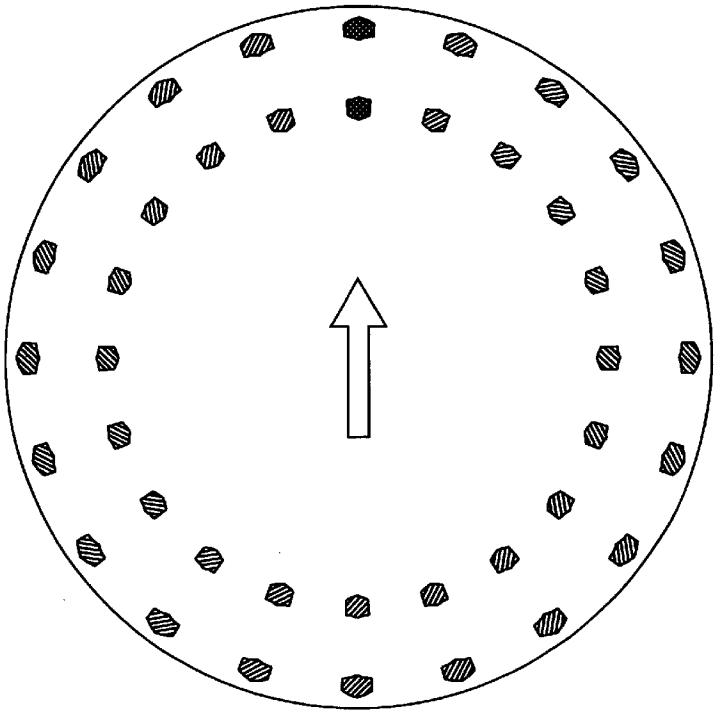
FIGS. 9A–9E are plan views corresponding to FIGS. 8A–8E showing the visual impression of the lower zone through the transmissive areas of the upper zone.
Figure 8A:
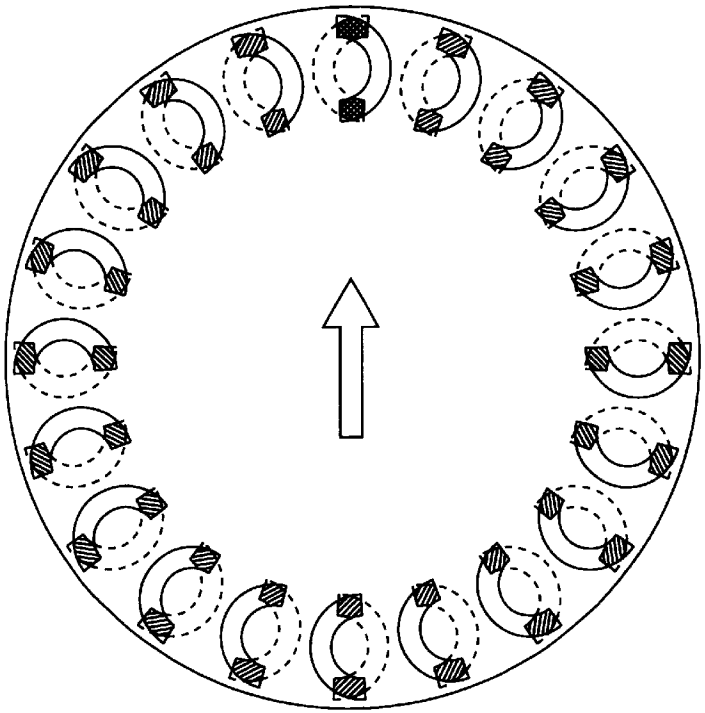
FIGS. 8A–8E are plan views of two overlapping annular zones showing a sequence of relative rotation.
Figure 9B:
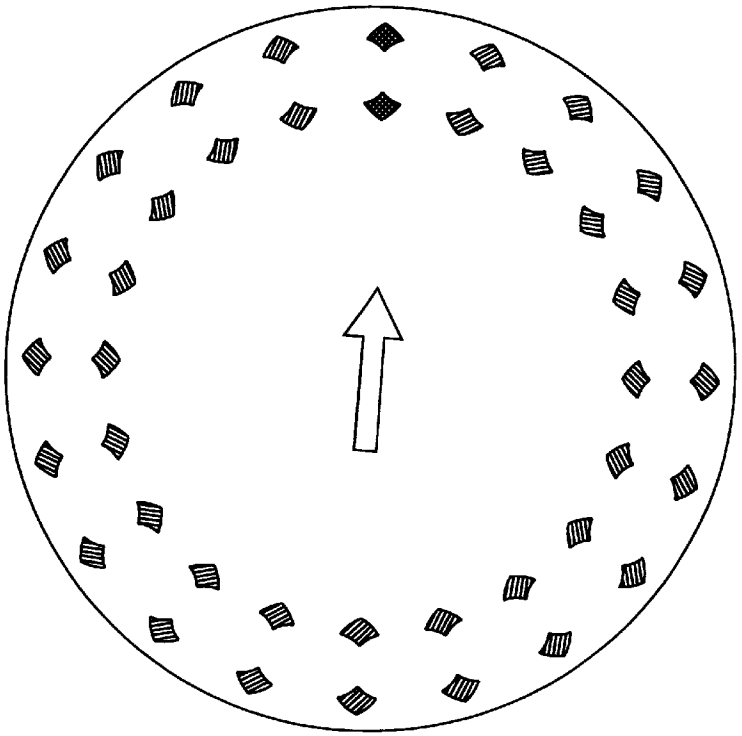
Figure 8B:
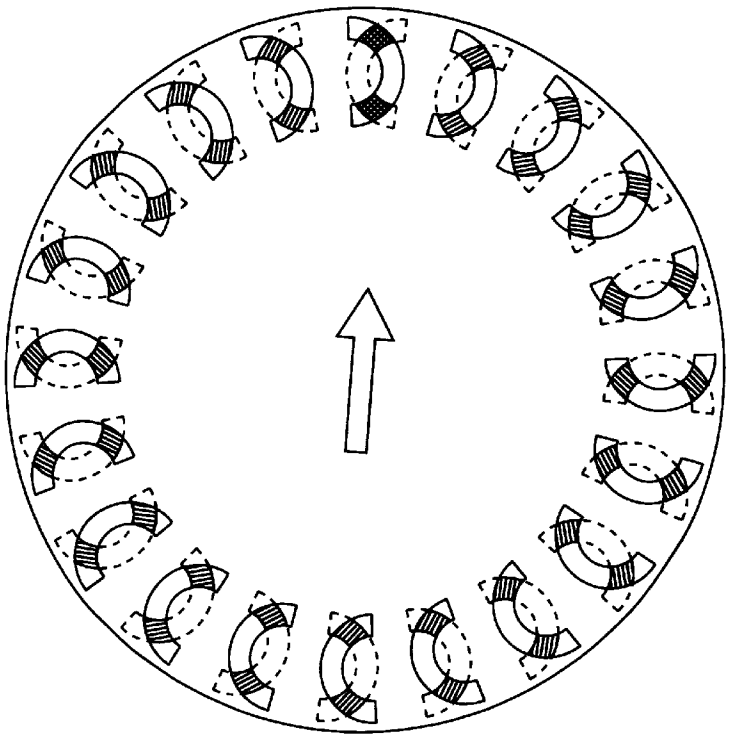
Figure 9C:
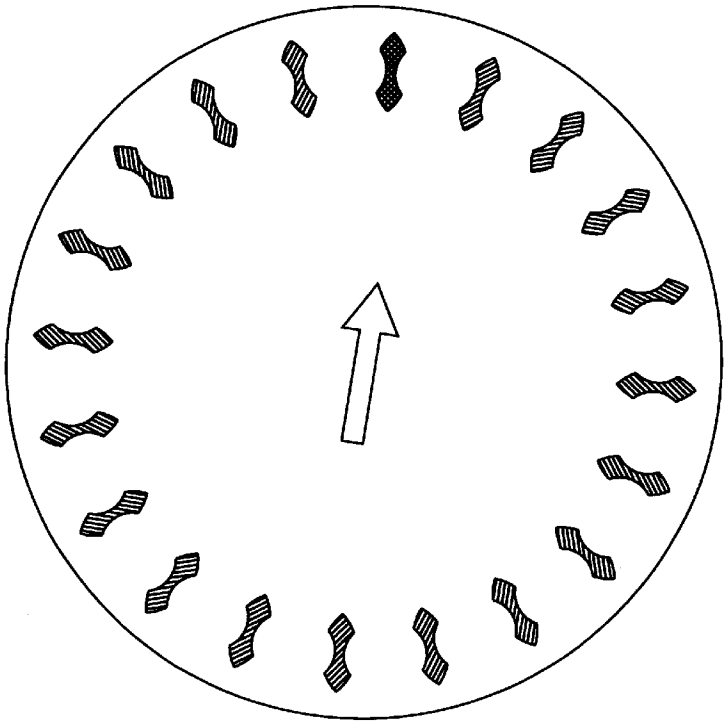
Figure 8C:
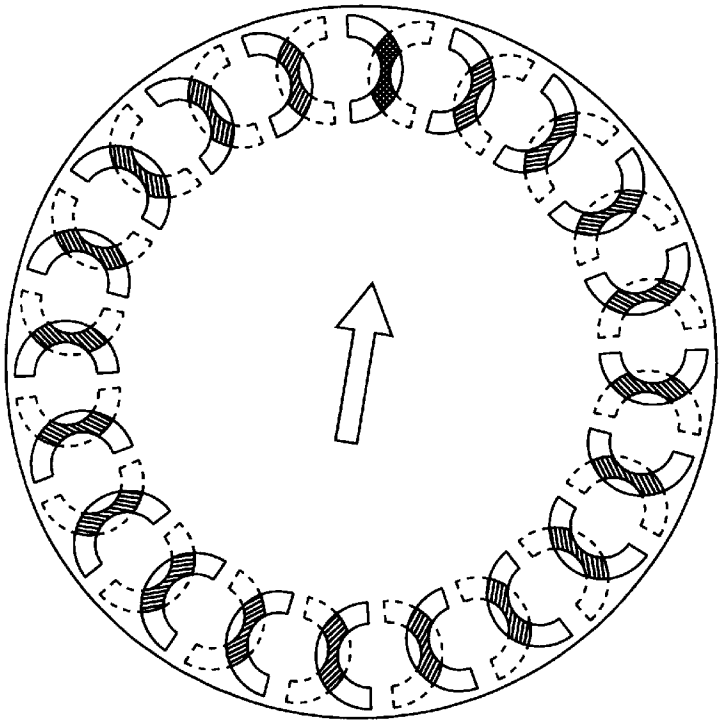
Figure 9D:
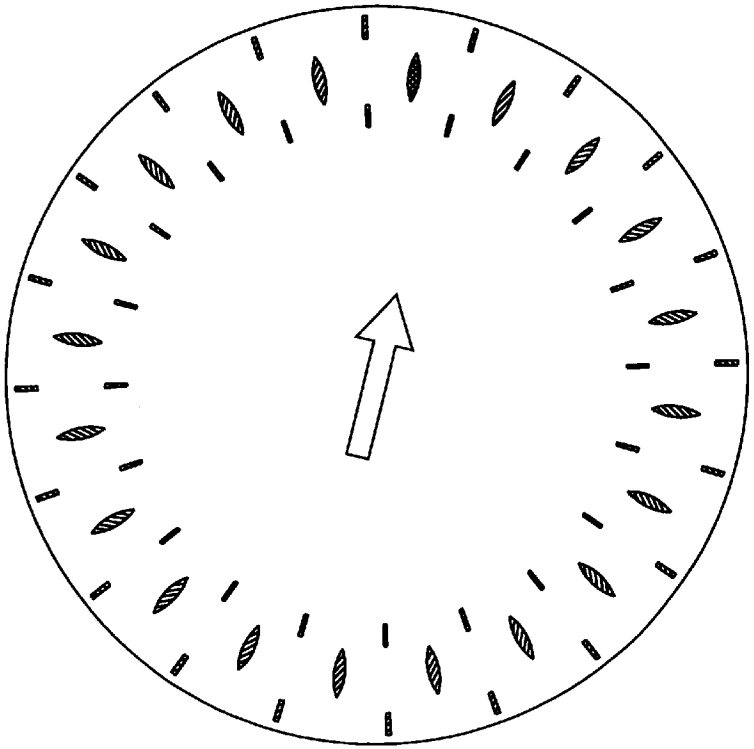
Figure 8D:
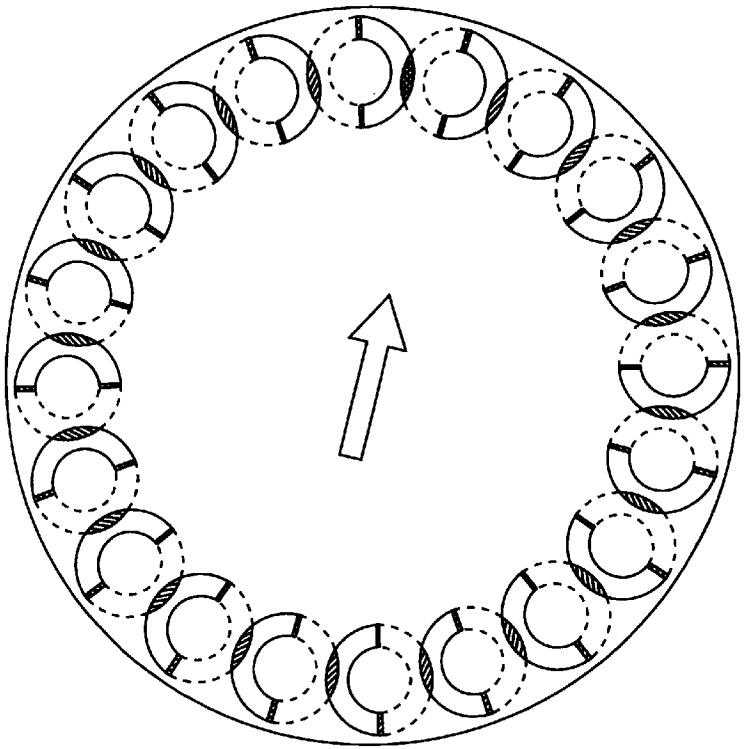
Figure 9E:
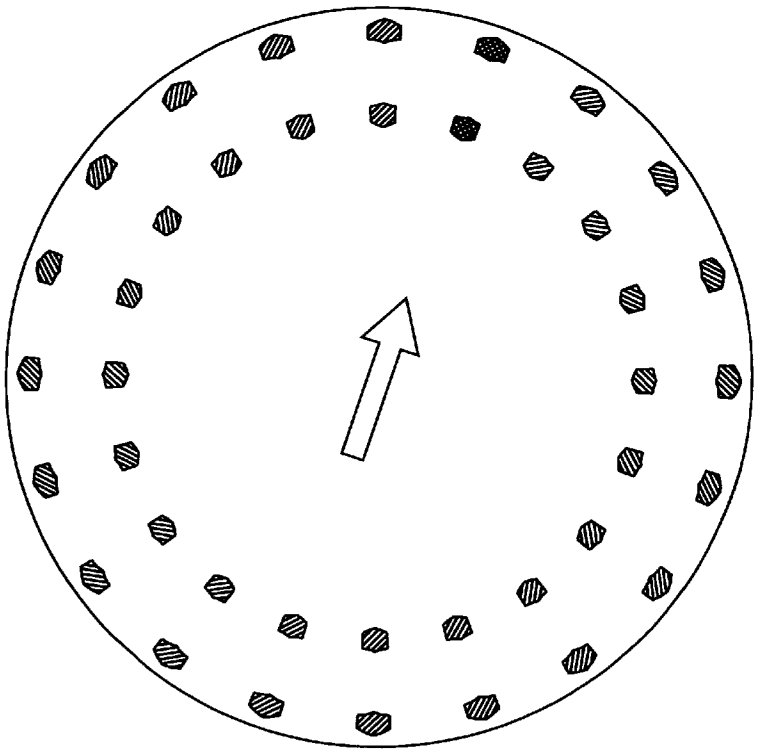
Figure 8E:
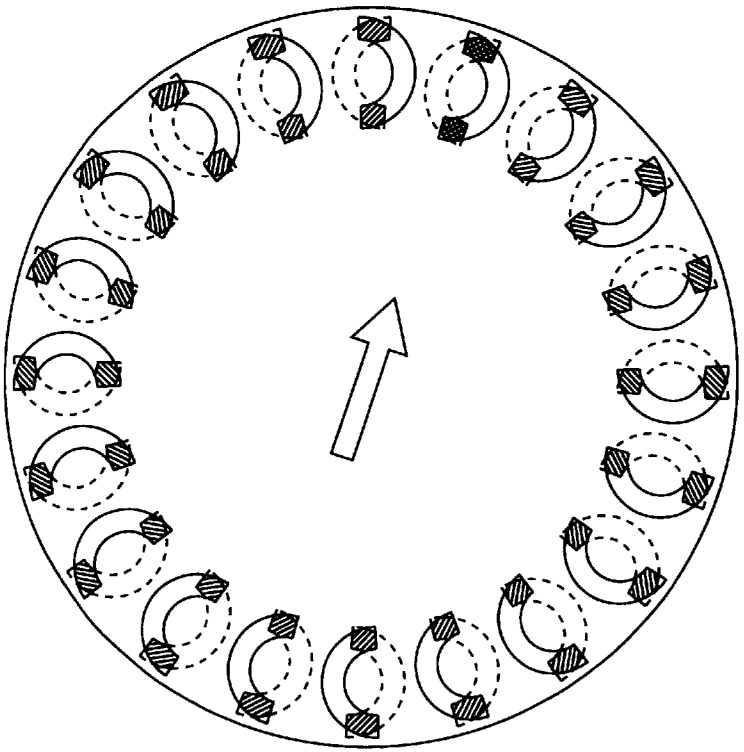

FIG. 7 is a cut-away plan view of the clock face of the second embodiment showing the patterns 38', 49', 59' including the indicator areas 39', 50', 60' through the respective transmissive areas 32', 44', 54'. The time in this case is 9:55:45.

The design of the transmissive areas of the mattes as well as the patterns of the fills is a matter of choice determined primarily by the desired visual effect of their relative motion. It should be borne in mind that the drawings presented herein necessarily represent instantaneous views which do not show the pleasing fluid motion inherent in the invention.

FIGS. 8A–8E show a sequence of a matte, indicated by solid lines, overlying a fill, indicated by dashed lines, with the indicator area cross hatched. FIGS. 9A–9E show the corresponding visual impressions of the fill pattern and indicator area as seen through the apertures of the matte. This visual impression changes continuously with the relative motion between each respective matte and fill.

Four layer configurations other than that shown in FIGS. 4 and 5 are possible. For example, the second lamina could carry the second fill and the minute matte, while the further lamina could carry the minute fill and the hour matte. However, since the further lamina is rotated at a frequency of one rotation per hour, i.e. the same frequency as a minute hand, there would be no impression of fluid motion as the hour matte rotates with respect to the underlying hour fill.

Figure 10:
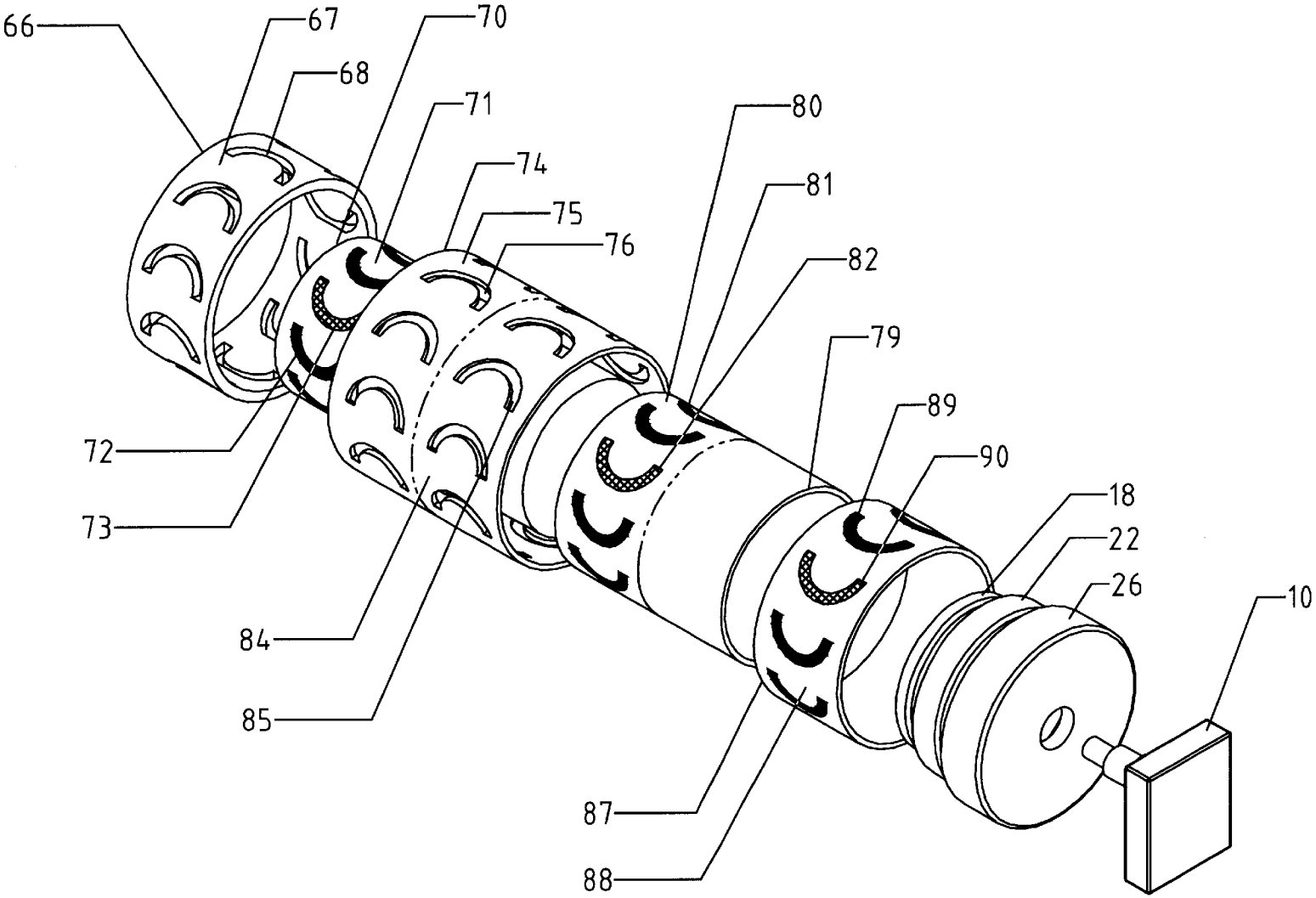
FIG. 10 is an exploded perspective of a cylinder clock according to the invention.
Figure 11:
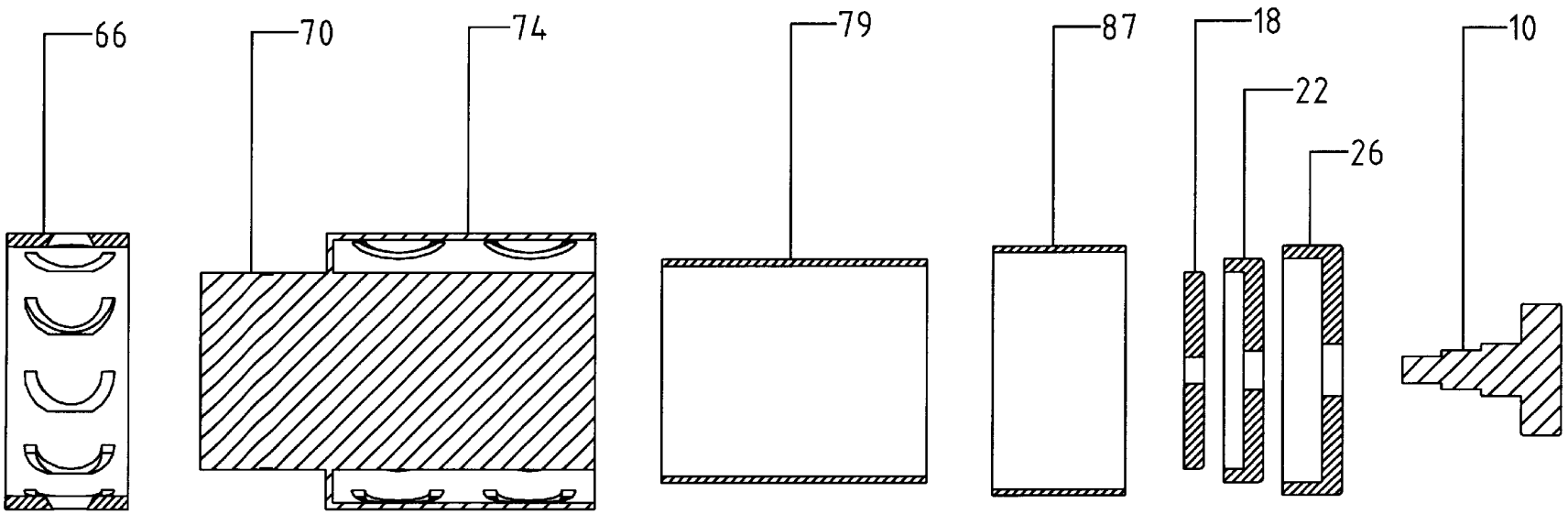
FIG. 11 is a cross-section of the cylinder clock of FIG. 10.

The principle of the invention is not limited to embodiments utilizing laminas, but can also be extended to concentric cylinders having ring-like zones carrying the mattes and fills for seconds, minutes, and hours. FIGS. 10–11 illustrate such an embodiment.

Referring to FIGS. 10 and 11, a first cylinder in the form of a sleeve 66 has a first ring-like zone or second matte 67 with regularly spaced transmissive areas 68 which are readily formed as apertures. A second cylinder 70 has a second ring-like zone or second fill 71 provided with patterns 72 including an indicator area 73. The second cylinder 70 is joined to a sleeve 74 which is concentric to the cylinder body and has a third ring-like zone or minute matte 75 with transmissive areas 76, and a fifth ring-like zone or hour matte 84 with transmissive areas 85. A third cylinder in the form of a sleeve 79 has a fourth ring-like zone or minute fill 80 provided with patterns 81 and an indicator area 82. A fourth cylinder in the form of a sleeve 87 has a sixth ring-like zone or hour fill 88 provided with patterns 89 including an indicator area 90. The sleeves 79 and 87 are received concentrically in the gap between the sleeve 74 and the body of second cylinder 70, so that the minute fill 80 is overlapped by the minute matte 75, and the hour fill 88 is overlapped by the hour matte 84.

As shown in FIG. 11, the second, third, and fourth cylinders 70, 79, 87, which carry the second, minute, and hour fills 71, 80, 88, are fixed to and driven by respective second, minute, and hour drive disks 18, 22, 26 so that the indicator areas appear to move vertically when the axis of rotation is horizontal. Thus, if the clock mechanism 10 drives its second, minute, and hour outputs with conventional periods of one minute, one hour, and twelve hours, the indicator areas will not be visible from a given side for half the time. It is therefore possible to double the conventional periods and provide two indicator areas 180 degrees apart on each fill, so that one indicator area disappears as the other appears.

The second cylinder 70 is shown in FIGS. 10 and 11 as a solid body and contemplates fills having patterns and indicator areas which are reflective, thereby requiring only ambient light. However it is also possible for the second cylinder to be in the form of a sleeve having a light source inside, and for the patterns of the fills to be transparent or translucent, the indicator areas being optically distinguishable from the rest of the respective ring-like zones. This provides a clock which would be useful in the absence of ambient light.

Figure 12A:
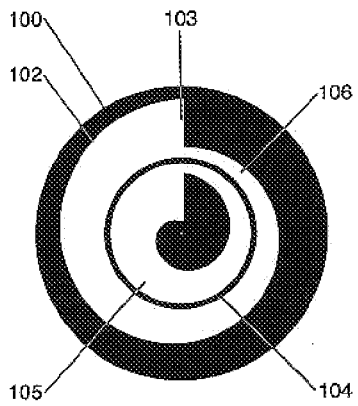
FIGS. 12A–12F are plan views of disks for a spiral clock.
Figure 12B:
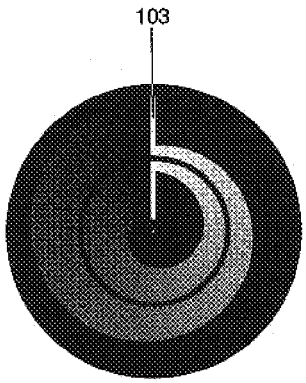

FIGS. 12A to 12F are schematic views of the patterns used on disks for another embodiment, which for reasons of convenience will be termed the "spiral" clock, although the principles are not limited to the patterns shown. FIG. 12A shows a first disk 100 having a first transparent zone 102 which is divided into an inner area 105 and an outer area 106 by an opaque circle 104. In the embodiment shown, the entire first zone 102 increases in width until it reaches an indicator area 103. However it will be understood that the increase need not be continuous over the entire 360 degrees; the width may both increase and decrease around the zone. FIG. 12B is a variant of the first disk shown in FIG. 12A, wherein the first zone not only increases in width, but is shaded from transparent toward opaque around the zone. This gives a sharp indication of the approach of indicator area 103. In a preferred embodiment, the first zone acts as a second fill, and likewise serves as the minute and hour mattes.

Figure 12C:
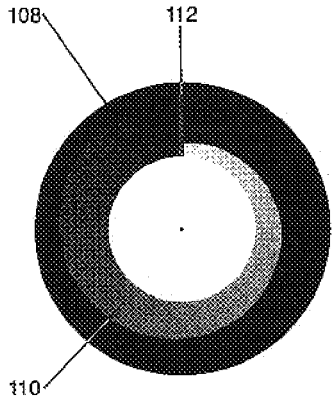

FIG. 12C is a schematic view of a second disk 108 having a second zone 110 which not only increases in width but is shaded from opaque white to opaque black, or otherwise shaded from light to dark, in order to give a sharp indication of the indicator area 112. The second zone 110 has a uniform inner radius which coincides with the radius of circle 104 in the first disk 100. The second disk 108 preferably serves as a minute fill.

Figure 12D:
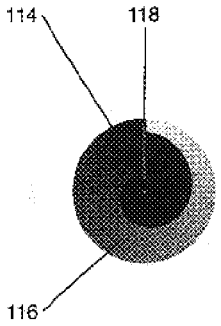
Figure 12E:
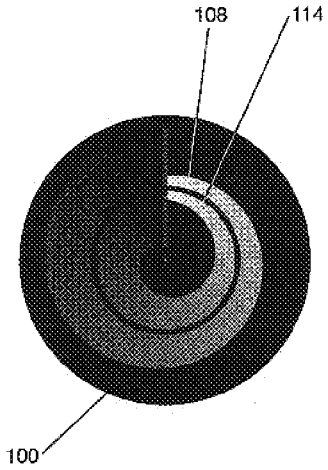

FIG. 12D is a schematic view of a third disk 114 having a third zone 116 which not only increases in width but is shaded from opaque white to opaque black, or otherwise shaded from light to dark, in order to give a sharp indication of the indicator area 118. The third zone has a uniform outer radius which coincides with the radius of the opaque circle in the first disk 100. The third disk preferably serves as an hour fill. FIG. 12E shows the third disk 114 situated concentrically inside the second disk 108, with the superposition of the first disk 100, when the time is 12:00:00.

Figure 12F:
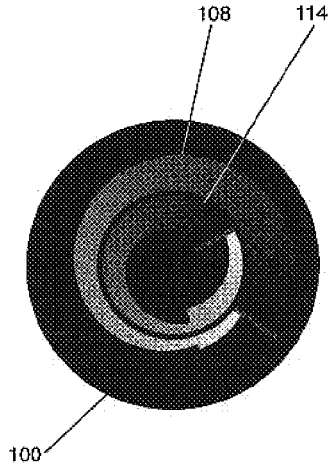

FIG. 12F is a schematic view showing the first disk 100 of FIG. 12A, and the second and third disks 108, 114, wherein the inner area 105 of the first disk overlaps the third disk 114, and the outer area 106 overlaps the second disk 108. As shown, the time is 2:21:27. The disk of FIG. 12B could also be used as a second fill. The disks are provided with appropriate apertures for mounting to a conventional drive of the type shown in FIG. 2.

Figure 13A:
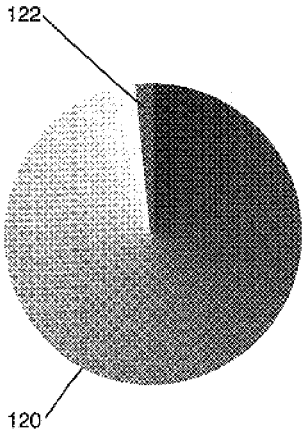
FIGS. 13A–13F are plan views of disks for a radar clock.
Figure 13B:
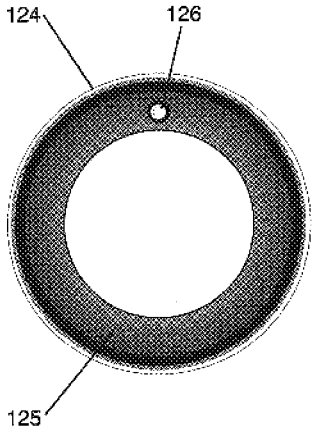
Figure 13C:
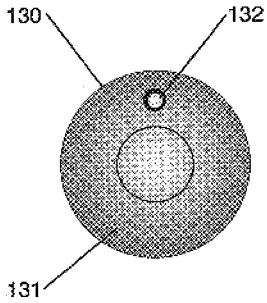
Figure 13D:
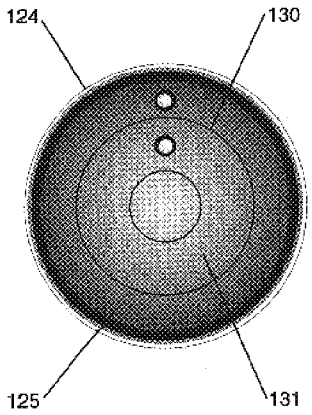

FIGS. 13A–13F are schematic views of the patterns used on disks for another embodiment, which for reasons of convenience will be termed the "radar" clock, although the principles are not limited to the patterns shown. FIG. 13A shows a first disk 120, having a continuous angular gradation in transmissivity, the lightest and darkest ends being separated by a first indicator area 122 in the form of a thin slice, on the order of about ten degrees. The first indicator area is preferably translucent and has a color which distinguishes it from the rest of the first disk. The first disk 120 preferably serves as a second fill, and likewise serves as a matte for the minute and hour fills. FIG. 13B shows a second disk 124 having a second zone 125 having a uniform inner radius surrounding a transparent area and an indicator area 126; this disk preferably serves as a minute fill. FIG. 13C shows a third disk 130 having a third zone 131 and an indicator area 132 having a uniform outer radius which roughly coincides with the inner radius of the second zone; this zone preferably serves as the hour fill, visible through the transparent area of the minute fill. FIG. 13D shows the superposition of the second and third disks 124, 130, with the third zone 131 concentrically inside the second zone 125.

Figure 13E:
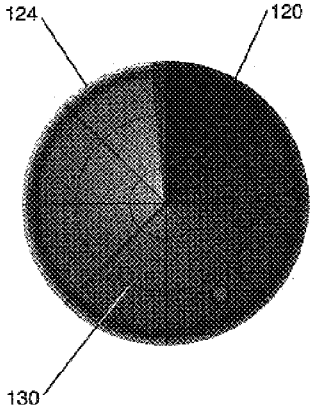
Figure 13F:
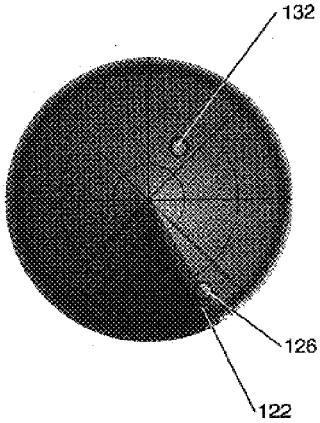

FIG. 13E shows the first disk 120 superposed over the second disk 124 and the third disk 130; the time as shown is 1:25:00. FIG. 13F shows the time at 1:25:26. While the indicator areas 126 and 132 are visible at all times, thereby giving a positive indication of the minutes and hours, the sweep of the first indicator area 122 thereover causes a sudden brightening so that the minute and hour indicators appear as "blips" on a radar screen. The graduations which appear at forty-five degree intervals are provided on a transparent cover element such as a watch crystal, in order to further the impression of a radar screen. The disks are provided with appropriate apertures for mounting to a conventional drive of the type shown in FIG. 2.

Figure 14:
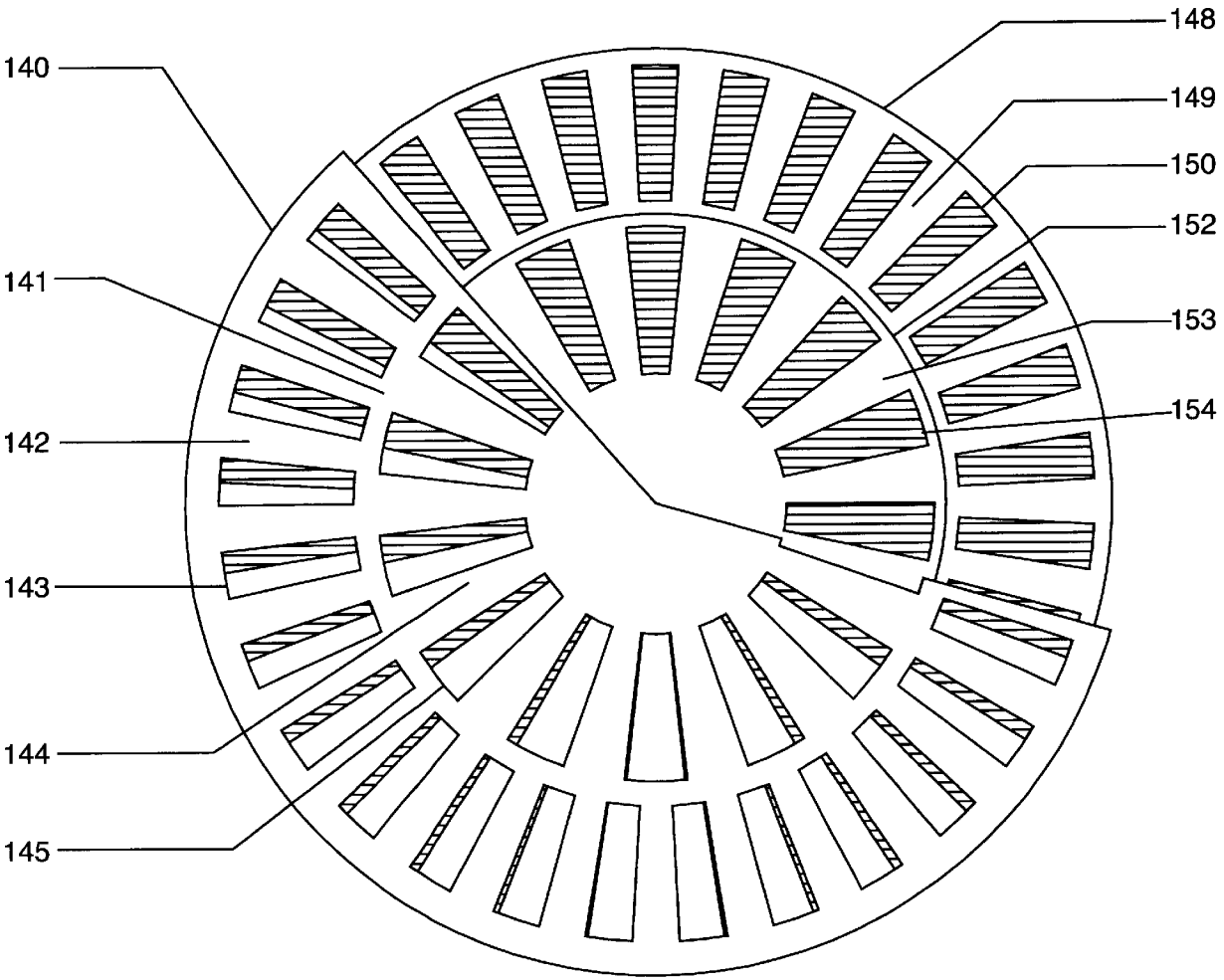
FIG. 14 is a cutaway plan view of a three disk timepiece with discrete transmissive areas.

FIG. 14 shows a three disk embodiment including a first disk 140 having a first zone 141 with a radially outer part 142 with discrete transmissive areas in the form of apertures 143 at regular angular intervals around the outer part, and a radially inner part 144 with discrete transmissive areas in the form of apertures 145 at regular angular intervals around the inner part. This is typically the second fill, and also serves as the matte for the minutes and hours. A second disk 148 has a second zone 149 with a plurality of discrete reflective areas 150 arranged at regular angular intervals around the second zone 149. This is typically the minute fill, the second disk 148 having a transparent central area so that the third disk 152 will be visible. The third disk 152 has a third zone 153 with a plurality of discrete reflective areas 154 at regular angular intervals around the third zone.

The number and spacing of the transmissive areas and the reflective areas can create a visual effect which is akin to that of a moving wagon wheel in a film. As shown, the outer part 142 of the first disk has twenty-nine apertures 143, while the second zone 149 has thirty reflective areas 150. The appearance of a complete reflective area 150 through an aperture 143 thus "rolls around" the outer area 142 approximately once every two seconds. With fifty-nine apertures over sixty reflective areas, the roll around period would be about one second. The inner part 144 has fourteen apertures 145, while the third zone 153 has fifteen reflective areas 154, which gives a "roll around" period of about four seconds. Note that the second and third indicator areas, used to indicate the minutes and hours, may be formed by making any one reflective area 150, 154 in each zone 149, 153 a different color than the other reflective areas in that zone.

Figure 15:
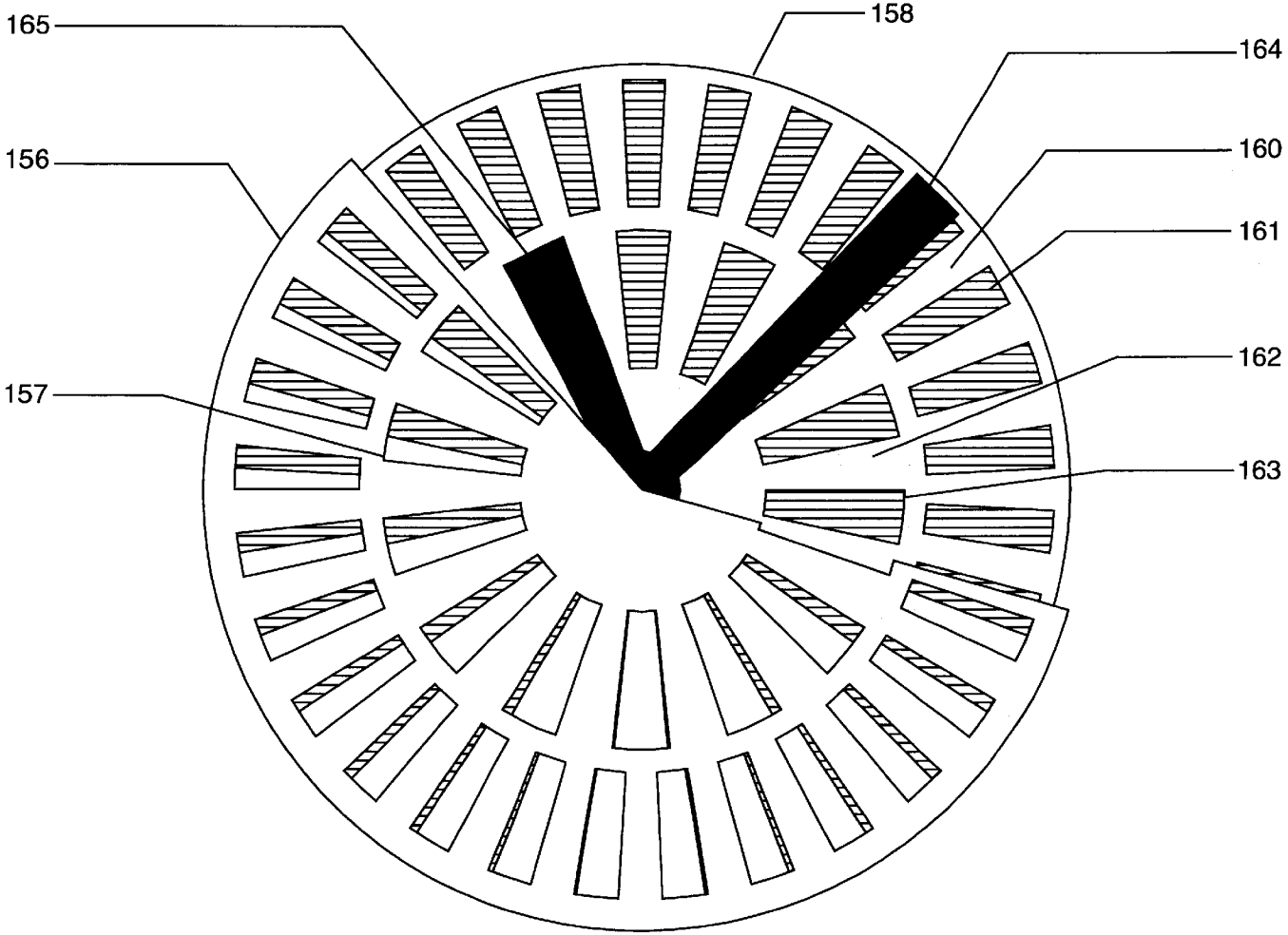
FIG. 15 is a cutaway plan view of a single disk timepiece with discrete transmissive areas.

FIG. 15 shows a timepiece which creates a similar visual effect as the timepiece of FIG. 14, albeit with only a single disk 156, which may be identical to the disk 140 of FIG. 14. However here the second zone 160 and third zone 162 with their respective reflective areas 161, 163 are provided on a stationary face 158, and a minute hand 164 and hour hand 165 are provided. Since the minute hand is conventionally driven over the hour hand, the minute hand 164 may have a transparent inner portion so that the hour hand 165 is always visible through the apertures 157 of the first disk 156, which is driven like a second hand with a period of one minute. It is also possible to have the minute indicator on a second disk, as in the embodiment of FIG. 14, and a conventionally driven hour hand which is visible through a tansparent area of the second disk.

Figure 16A:
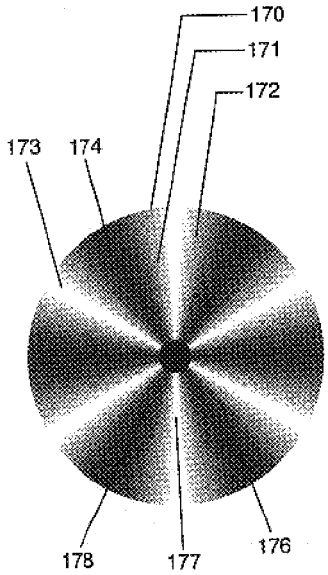
FIGS. 16A–16C show the components of a three disk timepiece having color changes at regular intervals.
Figure 16B:
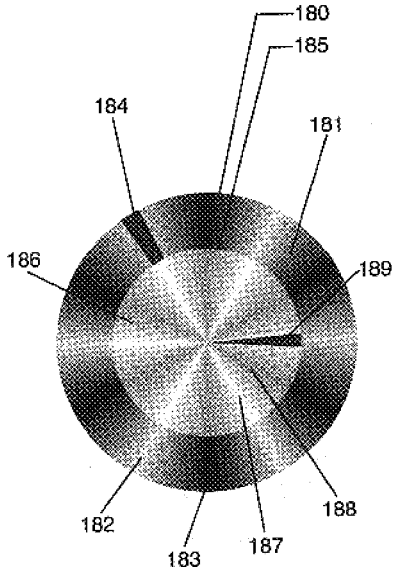
Figure 16C:
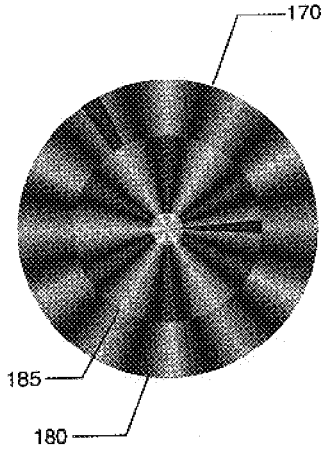

FIGS. 16A–16C show a three disk embodiment wherein each disk exhibits a change in transmissivity at regular angular intervals around the zones, however this is accomplished by gradual color change rather than discrete transmissive areas as in FIG. 14. FIG. 16A depicts a first disk 170 having a first zone 171 with an outer part 172 with alternating light and dark areas 173, 174, and an inner part 176 with alternating light and dark areas 177, 178. While this is shown in gray scale, the light and dark areas typically represent colors, and may be different in the inner and outer parts 172, 176, or may be the same. FIG. 16B shows a second disk 180 over a third disk 185 which serve as the minute and hour fills, respectively. The second disk 180 has a second zone 181 with alternating light and dark areas 182, 183 at regular angular intervals, and an indicator area 184. The third disk 185, which is visible through a transparent area of the second disk 180, has a third zone 186 with alternating light and dark areas 187, 188 at regular angular intervals, and an indicator area 189. Once again the light and dark areas preferably represent colors, and preferably alternate at the same regular angular intervals as the light and dark areas in the respective outer and inner areas of the first disk. FIG. 16C depicts the first disk 170 over the second and third disks 180, 185. The light and dark areas of the first disk are translucent, and cooperate with the light and dark areas of the second and third disks, which may be solely reflective. The movement of the first disk 170 over the second and third disks 180, 185 causes the colors to complement each other and give the appearance of a constant change in color at regular angular intervals, while still permitting the indicator areas to be seen.

Figure 17:
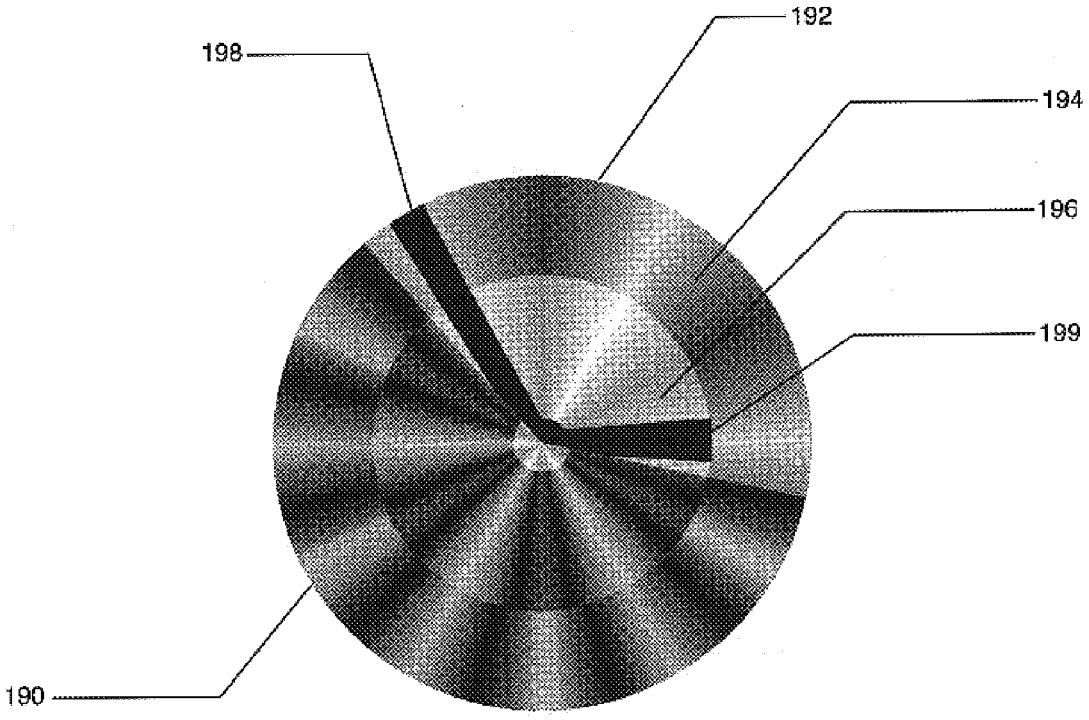
FIG. 17 is a cutaway plan view of a single disk timepiece having color changes at regular intervals.

FIG. 17 shows a cutaway of timepiece which creates a similar visual effect as the timepiece of FIGS. 16A–16C, albeit with only a single disk 190, which may be identical to the disk 170 of FIG. 16A. Here the second zone 194 and third zone 196 are provided on a stationary face 192, and a conventionally driven minute hand 198 and hour hand 199 are also provided. The arrangement of alternating light and dark areas at regular angular intervals around each of the zones is essentially the same as in FIGS. 16A to 16C.

As should now be apparent, the present invention, as for example shown in FIGS. 1 to 17 and hereinabove described, may be implemented in a variety of mechanical designs in which various physical parts or elements are disposed for individual and interconnected relative movement to provide a timepiece on which the current time is displayed or otherwise readily viewable and discernable. It is nevertheless also within the intended scope and contemplation of the invention that the inventive timepiece—also in a like variety of forms and designs—may instead be implemented digitally or otherwise electronically for providing a graphically-defined time display on a monitor such as, for example, a liquid crystal display (LCD) panel or cathode ray tube (CRT) monitor or any other graphical display. Thus, in currently preferred forms of such an electronic or digital implementation of the inventive timepiece the several relatively movable elements or components may be separately modeled or otherwise graphically created using a conventional or other software-based graphics program, and the so-created virtual elements may then be composited and animated (for providing the desired relative movement of these virtual elements) by the same or by another software program to provide the resulting digital timepiece display on a graphically-competent monitor. Although general purpose, conventional computer hardware and software may be employed to achieve such a digital timepiece, special purpose or custom hardware and/or software may alternatively, or also, be utilized for that purpose.

For example, in one implementation an Apple Macintosh PowerBook G4 computer running MacOS 9.1 may utilize Adobe Illustrator to define or create the various virtual laminas or layers or "disks"—formed, as in the physical, mechanical embodiments hereinabove described, of various combinations of predeterminately light transmissive and non-transmissive areas or portions or regions—which may then be composited and animated using Adobe After Effects software. In an alternate implementation, a Compaq 7000T personal computer running Microsoft Windows 2000 may utilize Autodesk AutoCAD and/or Adobe Illustrator and Adobe After Effects software for the same purposes. It is also anticipated that digital implementations of the inventive timepiece display may be output either on a screen or other (e.g. projected or head-up) display solely dedicated to that application, such as a wall-mounted timepiece display, or on a display that individually or simultaneously serves or accommodates one or more additional functions, such for example as the screen display of a handheld PDA (personal digital assistant), of a cellular telephone, or of a general purpose digital computer being used or selectively usable to run other executable applications.

Figure 18:
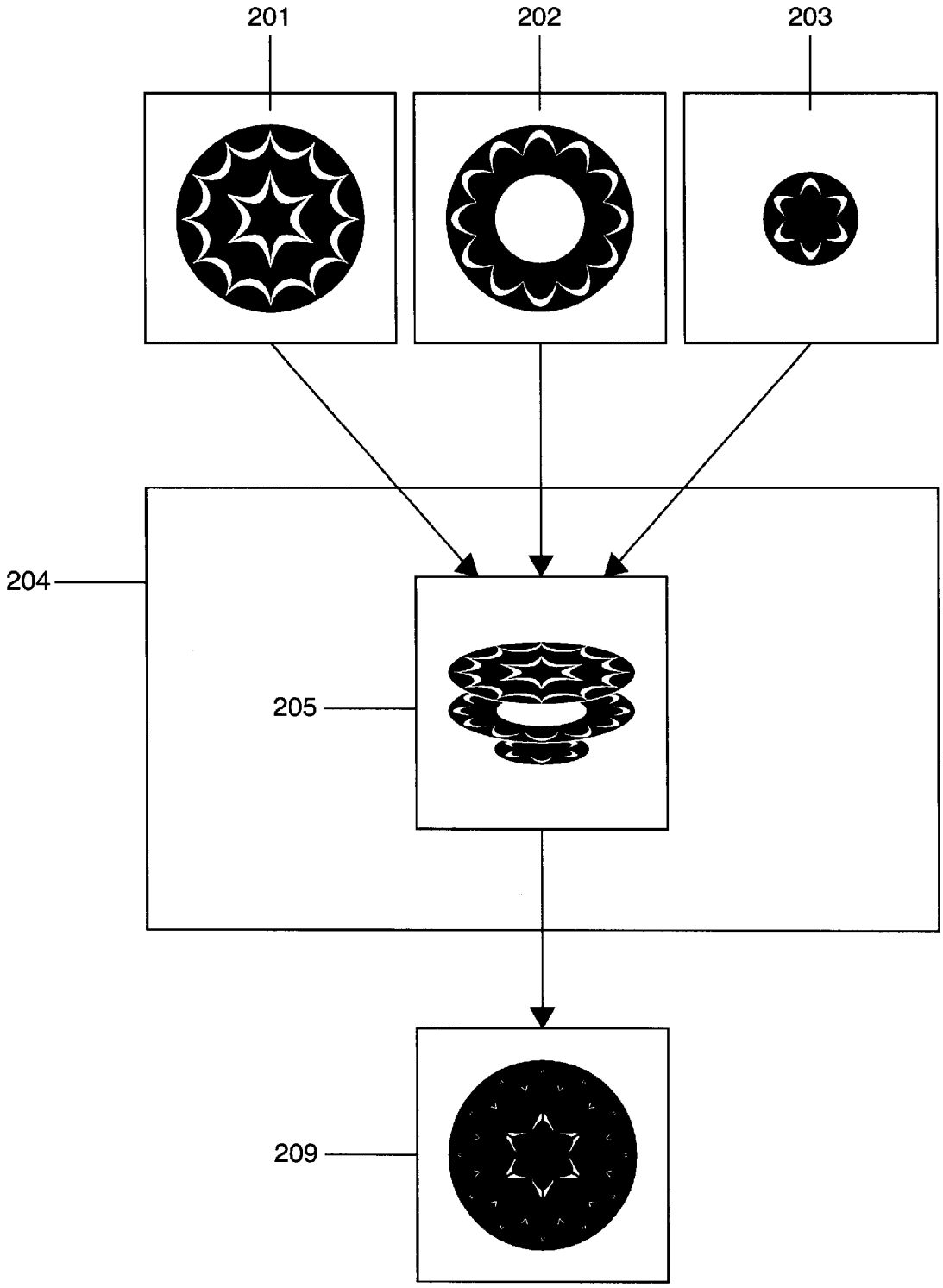
FIG. 18 is a schematic diagram for electronic implementation of the timepiece according to the invention.

In the illustrative digitally-implemented embodiment of the invention shown in FIG. 18, the virtual laminas or disks 201, 202, 203 are first created using a software-based graphics program as vector or raster images. A clock engine 204 calculates the appropriate geometric transformations (i.e. the necessary relative positions or movement(s) of the corresponding physical members) of the disks based on the current time. Compositing engine 205 then transforms and composites, i.e. animates, the images and the resultant image, as a digital timepiece 209, is thereby displayed.

What will therefore be apparent, and should now be clearly understood and appreciated, is that the present invention is not intended to be limited to timepieces implemented solely as physical, mechanical devices or mechanisms in which various disks or substrates or other physical elements each having certain light transmissive and non-transmissive regions or portions are predeterminately located and juxtapositioned and interconnected so that, through relative motion or movement of the physical elements, the current time is displayed on the device for a viewer of those physical elements. Specifically, additional and hybrid forms of the inventive timepiece, such as electronic, graphically-based digital implementations in which the physical elements of the mechanical embodiments are virtually modeled and virtually animated or repositioned to achieve on an electronic display a timepiece having the same functionality and like operation and appearance as the mechanically-implemented timepiece(s), are also within the scope and contemplation of the invention. Hybrid combinations of mechanical and electronic virtual elements or displays are also an intended part and aspect of the contemplated embodiments Note that while several of the embodiments have been described as comprising disks rather than laminas, it will be understood that the term disk, as used herein, includes any shape which includes a disk, such as a lamina having the form of an octagon.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A timepiece comprising a first annular zone with a plurality of discrete first transmissive areas spaced about said first annular zone, a second annular zone which is at least substantially coaxial with said first annular zone and substantially overlapped by said first annular zone, said second annular zone having a first indicator area which is optically distinguishable from the rest of the second annular zone and is visible through each of said first transmissive areas as said second annular zone is rotated with respect to said first annual zone, and means for rotating said second annular zone with a first period, whereby, a visual impression of time is obtained by observing the position of the first indicator area through said first transmissive areas.

2. A timepiece as in claim 1 wherein said discrete first transmissive areas are regularly spaced about said first annular zone, said second annular zone comprising a plurality of discrete first patterns regularly spaced about said second annular zone, said first patterns as seen through said first transmissive areas giving an impression of fluid movement as said second annular zone is rotated.

3. A timepiece as in claim 1 farther comprising a third annular zone which is at least substantially concentric to said first and second annular zones, said third annular zone comprising a plurality of discrete second transmissive areas spaced about said third annular zone, a fourth annular zone which is at least substantially coaxial with said third annular zone and substantially overlapped by said third annular zone, said fourth annular zone having a second indicator area which is optically distinguishable from the rest of the fourth annular zone, and means for rotating said fourth annular zone with a second period, whereby, a visual impression of time is obtained by observing the positions of the first and second indicator areas through respective first and second transmissive areas.

4. A timepiece as in claim 3 wherein said discrete second transmissive areas are regularly spaced about said third annular zone, said fourth annular zone comprising a plurality of discrete second patterns regularly spaced about said fourth annular zone, said second patterns as seen through said second transmissive areas giving an impression of fluid movement as said fourth annular zone is rotated.

5. A timepiece as in claim 3 comprising a first lamina comprising a transparent area surrounded by said first annular zone, a second lamina comprising said second annular zone and said third annular zone, said third annular zone being visible through said transparent area, and a further lamina comprising said fourth annular zone.

6. A timepiece as in claim 5 wherein said transparent area comprises an aperture in said first lamina.

7. A timepiece as in claim 3 comprising a first lamina comprising a transparent area surrounded by said first annular zone, a second lamina comprising a transparent area surrounded by said second annular zone, a third lamina comprising said third annular zone, said third annular zone being visible through said transparent areas surrounded by said first and second annular zones, and a fourth lamina comprising said fourth annular zone.

8. A timepiece as in claim 7 wherein said transparent area surrounded by said first annular zone comprises an aperture in said first lamina.

9. A timepiece as in claim 7 wherein said first and third laminas are stationary.

10. A timepiece as in claim 3 further comprising a fifth annular zone which is at least substantially concentric to said first, second, third, and fourth annular zones, said fifth annular zone comprising a plurality of discrete third transmissive areas spaced about said fifth annular zone, and a sixth annular zone which is at least substantially coaxial with said fifth annular zone and substantially overlapped by said fifth annular zone, said sixth annular zone having a third indicator area which is optically distinguishable from the rest of the sixth annular zone, and means for rotating said sixth annular zone with a third period, whereby, a visual impression of time is obtained by observing the positions of the first, second, and third indicator areas through respective first, second, and third transmissive areas.

11. A timepiece as in claim 10 wherein said discrete third transmissive areas are regularly spaced about said fifth annular zone, said sixth annular zone comprising a plurality of discrete third patterns regularly spaced about said sixth annular zone, said third patterns as seen through said third transmissive areas giving an impression of fluid movement as said sixth annular zone is rotated.

12. A timepiece as in claim 10 comprising a first lamina comprising a transparent area surrounded by said first annular zone, a second lamina comprising said second annular zone, said third annular zone, and said fifth annular zone, said third and fifth annular zones being visible through said transparent area surrounded by said first annular zone, a further lamina comprising a transparent area surrounded by said fourth annular zone, and a still further lamina comprising said sixth annular zone, said sixth annular zone being visible through said transparent areas surrounded by said fourth annular zone and said first annular zone.

13. A timepiece as in claim 12 wherein said transparent area surrounded by fourth annular zone comprises a transparent material, said means for rotating said fourth annular zone being fixed to said transparent material.

14. A timepiece as in claim 10 comprising a first lamina comprising a transparent area surrounded by said first annular zone, a second lamina comprising a transparent area surrounded by said second annular zone, a third lamina comprising a transparent area surrounded by said third annular zone, said third annular zone being visible through said transparent area surrounded by said first annular zone, a fourth lamina comprising a transparent area surrounded by said fourth annular zone, a fifth lamina comprising said fifth annular zone, said fifth annular zone being visible through said transparent areas surrounded by said first, second, third and fourth annular zones, and a sixth lamina comprising said sixth annular zone.

15. A timepiece as in claim 14 wherein at least one of said transparent areas surrounded by said first and third annular zones comprises an aperture in a respective at least one of said first and third laminas.

16. A timepiece as in claim 14 wherein said transparent areas surrounded by said second and fourth annular zones comprise a transparent material, said means for rotating said second annular zone being fixed to said transparent material of said second lamina, said means for rotating said fourth annular zone being fixed to said transparent material of said fourth lamina.

17. A timepiece as in claim 14 wherein said first, third, and fifth laminas are stationary.

18. A timepiece as in claim 10 wherein said first period corresponds to one minute, said second period corresponds to one hour, and said third period corresponds to one of twelve hours and twenty-four hours.

19. A timepiece as in claim 18 wherein said second annular zone rotates with a frequency of one minute, said fourth annular zone lies concentrically inside said second annular zone and rotates with a frequency of one hour, and said sixth annular zone lies concentrically inside of said fourth annular zone and rotates with a frequency of twelve hours.

20. A timepiece as in claim 12 wherein at least one of said first, second, and third transmissive areas consists of apertures through the respective first, second, and third laminas.

21. A timepiece as in claim 14 wherein at least one of said first, second, and third transmissive areas consists of apertures in the respective first, third, and fifth laminas.

22. A timepiece as in claim 10 wherein at least one of said first, second, and third indicator areas is transmissive to light, said timepiece further comprising a light source which backlights said annular zones.

23. A timepiece as in claim 10 wherein at least one of said first, second, and third indicator areas is reflective to light.

24. A timepiece comprising a first ring-like zone with a plurality of first transmissive areas spaced about at least part of said first zone, a second ring-like zone which is at least substantially coaxial to said first ring-like zone and substantially overlapped by said first ring-like zone, said second ring-like zone having at least one first indicator area which is optically distinguishable from the rest of the second ring-like zone and is visible through each of said first transmissive areas as said second ring-like zone is rotated with respect to said first ring-like zone, and means for rotating said second ring-like zone with a first period, whereby, a visual impression of time is obtained by observing the position of the first indicator area through said first transmissive areas.

25. A timepiece as in claim 24 wherein said first and second ring-like zones each comprises a cylindrical surface, said second zone being coaxial to said first zone.

26. A timepiece as in claim 24 wherein said discrete first transmissive areas are regularly spaced about said first ring-like zone, said second ring-like zone comprising a plurality of discrete first patterns regularly spaced about said second ring-like zone, said first patterns as seen through said first transmissive areas giving art impression of fluid movement as said second ring-like zone is rotated.

27. A timepiece as in claim 24 further comprising a third ring-like zone which is coaxial with and offset from said first and second ring-like zones, said third zone comprising a plurality of second transmissive areas regularly spaced about at least part of said third zone, a fourth ring-like zone which is coaxial with said third zone and substantially overlapped by said third zone, said fourth zone having at least one second indicator area which is optically distinguishable from the rest of the fourth annular zone, and means for rotating said fourth zone with a second period, whereby, a visual impression of time is obtained by observing the positions of the first and second indicator areas through respective first and second transmissive areas.

28. A timepiece as in claim 24 wherein each of said third and fourth zones comprises a cylindrical surface, said fourth zone being concentric to said third zone.

29. A timepiece as in claim 27 wherein said discrete second transmissive areas are regularly spaced about said third ring-like zone, said second ring-like zone comprising a plurality of discrete second patterns regularly spaced about said fourth ring-like zone, said second patterns as seen through said second transmissive areas giving an impression of fluid movement as said fourth ring-like zone is rotated.

30. A timepiece as in claim 27 further comprising a fifth ring-like zone which is coaxial with and offset from said first, second, third, and fourth zones, said fifth zone comprising a plurality of third transmissive areas regularly spaced about at least part of said fifth zone, and a sixth ring-like zone which is coaxial with said fifth zone and substantially overlapped by said fifth zone, said sixth zone having at least one third indicator area which is optically distinguishable from the rest of the sixth zone, and means for rotating said sixth zone with a third period, whereby, a visual impression of time is obtained by observing the positions of the first, second, and third indicator areas through respective first, second, and third transmissive areas.

31. A timepiece as in claim 30 wherein each of said fifth and sixth zones comprises a cylindrical surface, said sixth zone being at least substantially coaxial to said fifth zone.

32. A timepiece as in claim 30 wherein said discrete third transmissive areas axe regularly spaced about said fifth ring-like zone, said sixth ring-like zone comprising a plurality of discrete third patterns regularly spaced about said sixth ring-like zone, said third patterns as seen through said third transmissive areas giving an impression of fluid movement as said sixth annular zone is rotated.

33. A timepiece comprising a first disk having a central axis and a surrounding first zone having a radial width and a transmissivity, said radial width of said first zone exhibiting a continuous increase in an angular direction around said axis, said first zone comprising a first indicator area which marks at least one of a beginning and an end of said angular increase of said radial width of said first zone, means for rotating said first disk with a first period, a second disk which is coaxial with said first disk and has a surrounding second zone which is overlapped by said first zone, said second zone having a radial width and a reflectivity, said radial width of said second zone exhibiting a continuous increase in an angular direction about said axis, said second zone comprising a second indicator area which marks at least one of a beginning and an end of said angular increase of said radial width of said second zone, whereby, a visual impression of time is obtained by viewing said indicator area in said first zone and by viewing said indicator area in said second zone through said first zone.

34. A timepiece as in claim 33 wherein said transmissivity of said first zone exhibits a continuous increase in an angular direction around said axis.

35. A timepiece as in claim 33 wherein said reflectivity of said second zone exhibits a continuous increase in an angular direction around said axis.

36. A timepiece as in claim 33 further comprising a third disk which is coaxial with said first disk and has a surrounding third zone which is radially adjacent to said second zone and overlapped by said first zone, said third zone having a radial width and a reflectivity, said radial width of said third zone exhibiting a continuous increase in an angular direction about said axis, said third zone comprising a third indicator area which marks at least one of a beginning and an end of said angular increase of said radial width of said third zone, and means for rotating said third disk with a third period.

37. A timepiece as in claim 36 wherein said reflectivity of said third zone exhibits a continuous increase in an angular direction about said axis.

38. A timepiece as in claim 36 wherein said third zone lies radially inside of said second zone, said radial width of said second zone being bounded by an inner radius which is substantially constant, said radial width of said third zone being bounded by an outer radius which is substantially constant.

39. A timepiece as in claim 38 wherein said inner radius of said second zone is substantially contiguous with said outer radius of said third zone.

40. A timepiece as in claim 39 wherein said first zone comprises a radially outer part lying over said second zone and a radially inner part lying over said third zone, said outer part having an inner radius which is substantially same as the inner radius of the second zone, said inner part having an outer radius which is substantially the same as the outer radius of the third zone.

41. A timepiece as in claim 39 wherein said first period is one minute, said second period is one hour, and said third period is one of twelve hours and twenty four hours.

42. A timepiece comprising a first zone having a radially inner part and a radially outer part surrounding said axis, said inner part and said outer part each comprising one of a continuous transmissive area and a plurality of discrete transmissive areas, means for rotating said first zone with a first period, a second zone surrounding said axis and overlapped by said radial outer part of said first zone, said second zone being visible through said one of said continuous transmissive area and said plurality of discrete transmissive areas of said radially outer part of said first zone, said second zone having an indicator area which occupies an angular position in said second zone, means for rotating said indicator area in said second zone with a second period, a third zone surrounding said axis inside of said second zone and being overlapped by said radial inner part of said first zone, said third zone being visible through said one of said continuous transmissive area and said plurality of discrete transmissive areas of said inner part of said first zone, said third zone having an indicator area which occupies an angular position in said third zone, and where by, a visual impression of time is obtained by viewing said indicator area in said second zone through said one of said continuous transmissive area and said plurality of discrete transmissive areas in said out part of said first zone, and by viewing said indicator area in said third zone through said one of said continuous transmissive area and said plurality of discrete transmissive areas in said inner part of said first zone.

43. A time piece as in claim 42 further comprising a first disk having said first zone thereon, a second disk which is coaxial with said first disk and has said second zone thereon, said indicator area in said second zone occupying a fixed position with respect to said second zone, said means for rotating said indicator area m said second zone rotating said second disk with said second period, and a third disk which is coaxial with said first disk and has said third zone thereon, said indicator area in said third zone occupying a fixed position with respect to said third zone, said means for rotating said indicator area in said third zone rotating said third disk with said third period.

44. A timepiece as in claim 43 wherein said each of said inner and outer parts of said first zone comprises a continuous transmissive area having a radial width which exhibits a continuous increase in an angular direction around said axis, said first zone further comprising a first indicator area marking at least one of a beginning and an end of said angular increase of said radial width of each of said inner and outer parts of said first zone, said second zone has a radial width which exhibits a continuous increase in said angular direction around said axis, said indicator area of said second zone marking at least one of a beginning and an end of said angular increase of said radial width of said second zone, and said third zone has a radial width which exhibits a continuous increase in said angular direction around said axis, said indicator area of said third zone marking at least one of a beginning and an end of said angular increase of said radial width of said third zone.

45. A timepiece as in claim 44 wherein said continuous transmissive area exhibits a transmissivity which increases in an angular direction about said axis.

46. A timepiece as in claim 44 wherein at least one of said second and third zones has a reflectivity which exhibits a continuous increase in an angular direction about said axis.

47. A timepiece as in claim 43 wherein each of said inner part and said outer part of said first zone comprises a plurality of discrete transmissive areas, whereby a visual impression of time is obtained by observing the position of said indicator areas in said second and third zones through said discrete transmissive areas in respective said outer and inner parts of said first zone.

48. A timepiece as in claim 43 wherein each of said second and third zones comprises one of a plurality of discrete reflective areas and a plurality of discrete transmissive areas, said indicator areas being optically distinguishable from said one of said discrete reflective areas and said discrete transmissive areas.

49. A timepiece as in claim 42 wherein said radial inner part and said radial outer part comprise a continuous transmissive area which exhibits a continuous increase in transmissivity in an angular direction about said axis.

50. A timepiece as in claim 48 wherein said first zone further comprises a first indicator area which occupies an angular area outside of said area exhibiting a continuous increase in transmissivity, said first indicator area being optically distinguishable from the rest of the zone, whereby said indicator areas of said second and third zones exhibit a change of appearance as said first indicator zone passes thereover.

51. A timepiece as in claim 50 further comprising a transparent cover over said first zone, said transparent cover having radial graduations which appear at regular angular intervals on said cover.

52. A timepiece as in claim 50 further comprising a stationary face on which at least one of said second and third zones is provided, said indicator area in at least one of said second and third zones being rotated relative to said face.

53. A timepiece as in claim 52 further comprising radial graduations which appear at regular angular intervals on said face.

54. A timepiece comprising a first disk having a central axis, a first zone having a radially outer part and a radially inner part surrounding said axis, said outer part and said inner part each having a uniform radial width, said outer part and said inner part each exhibiting a change in transmissivity at regular angular intervals around said axis, said change occurring along the entire radial width of each of the parts, means for rotating said first disk with a first period, and a second zone surrounding said axis and having a uniform radial width, said second zone being overlapped by said radially outer part of said first zone and exhibiting a change in reflectivity at regular angular intervals around said axis, said change occurring along the entire radial width of the second zone, said second zone having an indicator area which occupies an angular position in said second zone, means for rotating said indicator area in said second zone with a second period, a third zone surrounding said axis inside said second zone and having a uniform radial width, said third zone being overlapped by said radial inner part of said first zone and exhibiting a change in reflectivity at regular angular intervals around said axis, said change occurring along the entire radial width of the third zone, said third zone having an indicator area which occupies an angular position in said third zone, and whereby, visual impression of time is obtained by viewing said indicator area in said second zone through said outer part of said first zone, and by viewing said indicator area in said third zone through said inner part of said first zone.

55. A timepiece as in claim 54 further comprising a second disk which is coaxial with said first disk and has said second zone thereon, said indicator area in said second zone occupying a fixed position with respect to said second zone, said means for rotating said indicator area in said second zone rotating said second disk with said second period, and a third disk which is coaxial with said first disk and has said third zone thereon, said indicator area in said third zone occupying a fixed position with respect to said third zone, said means for rotating said indicator area in said third zone rotating said third disk with said third period.

56. A timepiece as in claim 54 further comprising a stationary face on which at least one of said second and third zones is provided, said indicator area in said at least one of said second and third zones being rotated relative to said face.

57. A timepiece as in claim 56 wherein said second and third zones are provided on said stationary face, said indicator areas in said second and third zones being rotated relative to said stationary face.

58. A timepiece as in claim 54 wherein said outer part of said first zone and said second zone each exhibit different colors at a regular angular interval, said colors of said second zone combining with said colors of said outer part of said first zone to give an impression of regularly changing colors of said outer part of said first disk as said first disk is rotated.

59. A timepiece as in claim 58 wherein said different colors in adjacent said intervals in at least one of said outer part of said first zone and said second zone fade from one said color into another said color.

60. A timepiece as in claim 54 wherein said inner part of said first zone and said third zone each exhibit different colors at a regular angular interval, said colors of said inner part of said face combining with said colors of said inner part of said disk to give an impression of regularly changing colors of said inner part of said disk as said disk is rotated.

61. A timepiece as in claim 60 wherein said different colors in adjacent said intervals in at least one of said inner part of said first zone and said third zone fade from one said color into another said color.

62. A timepiece as in claim 54 wherein said outer part of said first disk has discrete transmissive areas at a first regular angular interval, and said second zone has discrete reflective areas at a second regular angular interval.

63. A timepiece as in claim 62 wherein said discrete transmissive areas and said discrete reflective areas have substantially the same angular width.

64. A timepiece as in claim 62 wherein said first regular angular interval is different than said second regular angular interval, said discrete transmissive areas being one of more and less in number than said discrete reflective areas.

65. A timepiece as in claim 54 wherein said inner part of said first disk has discrete transmissive areas at a first regular angular interval, and said third zone has discrete reflective areas at a second regular angular interval.

66. A timepiece as in claim 65 wherein said discrete transmissive areas and said discrete reflective areas have substantially the same angular width.

67. A timepiece as in claim 65 wherein said first regular angular interval is different than said second regular angular interval, said discrete transmissive areas being one of more and less in number than said discrete reflective areas.

* * * * *

UNITED STATES PATENT AND TRADEMARK OFFICE

CERTIFICATE OF CORRECTION

PATENT NO. : 6,754,139 B2
DATED : June 22, 2004
INVENTOR(S) : Herbstman et al.

It is certified that error appears in the above-identified patent and that said Letters Patent is hereby corrected as shown below:

Column 12,
Line 20, replace "annual" with -- annular --.

Signed and Sealed this

Twentieth Day of December, 2005

JON W. DUDAS
*Director of the United States Patent and Trademark Office*